US006620580B2

(12) United States Patent
Platt et al.

(10) Patent No.: US 6,620,580 B2
(45) Date of Patent: Sep. 16, 2003

(54) COLOR NEGATIVE ELEMENT CONTAINING TRIPLE-COATED BLUE RECORD AND METHOD OF IMAGING USING SAME

(75) Inventors: Norma B. Platt, Webster, NY (US); Drake M. Michno, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 2 days.

(21) Appl. No.: 09/993,533

(22) Filed: Nov. 14, 2001

(65) Prior Publication Data

US 2003/0143498 A1 Jul. 31, 2003

(51) Int. Cl.[7] ..... G03C 1/46

(52) U.S. Cl. ..... 430/505; 430/506; 430/552; 430/553; 430/556; 430/557; 430/544; 430/955; 430/957

(58) Field of Search ..... 430/505, 506, 430/552, 553, 556, 557, 544, 955, 957

(56) References Cited

U.S. PATENT DOCUMENTS

RE28,760 E * 4/1976 Marchant et al. ..... 430/506
4,707,436 A * 11/1987 Sasaki ..... 430/506
4,806,459 A * 2/1989 Makino et al. ..... 430/544
4,849,325 A * 7/1989 Sasaki et al. ..... 430/544
5,034,310 A 7/1991 Ikeda et al.
5,077,182 A * 12/1991 Sasaki et al. ..... 430/957
5,283,164 A 2/1994 Fenton et al.
5,314,794 A * 5/1994 Sutton ..... 430/506
5,478,704 A 12/1995 Taniguchi et al.
5,770,354 A 6/1998 Massirio et al.

* cited by examiner

*Primary Examiner*—Geraldine Letscher
(74) *Attorney, Agent, or Firm*—Arthur E. Kluegel

(57) ABSTRACT

Disclosed is a photographic element comprising a support bearing a blue light sensitive record containing at least three layers having different levels of light sensitivity arranged in the order slowest to fastest with the slowest layer closest to the support and the fastest layer closest to the light exposure source, wherein (a) all of the blue-sensitive layers are closer to the light exposure source than the layers sensitive to any other color; (b) the slowest blue light sensitive layer is at least 1.0 log E slower than the next fastest blue light sensitive layer when measured at a density of 0.15 above Dmin, and contains a particular type of cyan dye-forming development inhibitor releasing (DIR) coupler; and (c) all of the blue light sensitive layers other than the slowest blue light sensitive layer independently contain a certain type of yellow dye-forming DIR coupler. Embodiments of the invention provide improved color rendition without sacrificing blue density.

20 Claims, 3 Drawing Sheets

COLOR NEGATIVE ELEMENT CONTAINING TRIPLE-COATED BLUE RECORD AND METHOD OF IMAGING USING SAME

FIELD OF THE INVENTION

This invention relates to a color negative silver halide film element in which there are present three yellow dye-forming layers of differing light sensitivity in which the layers and DIR inhibitor couplers contained therein are arranged so as to provide improved color rendition without sacrificing blue density.

BACKGROUND OF THE INVENTION

Silver halide imaging systems based on chromogenic processing of multistage elements, such as the film-paper system most commonly used for consumer photography, afford significant opportunities to affect the quality, especially as related to color, of the reproduced image. The color quality sub-domains of 'colorfulness' or saturation and 'faithfulness' or hue accuracy are influenced by multiple design elements contained within the capture (first stage) media. Included in the list of factors which affect saturation and hue accuracy are (i) the spectral sensitivity of the capture media; (ii) hue characteristics of the individual dyes generated in the capture media upon chromogenic processing and (iii) the level of inter-channel (R, G, B) communications or interlayer interimage effects (IIE). In general, IIE plays a preeminent role in dictating the level of saturation and has a secondary effect on hue accuracy in the optical execution of the color negative imaging chain. Not surprisingly then, most modern color negative films designed for high speed optical printing feature incorporated technologies which provide IIE.

However, one of the more serious detractors associated with aggressive use of IIE technology to enhance color quality is the inability to control, in a site specific manner, the inhibiting impact one layer (causer) has on a desired target layer (receiver) without affecting other (unintended receiver) layers. For example, use of a development inhibitor releasing (DIR) coupler in a red sensitive (causer) element to generate desired IIE on the green sensitive (desired receiver) record, denoted as R→G, has a parallel and not necessarily desired effect of influencing the response of the blue sensitive (undesired receiver) record, denoted R→B.

One method for managing this limitation is the use of colored (or 'masking') couplers to provide the desired site specific color enhancement in the example above. Use of a magenta-colored coupler which provides cyan dye upon chromogenic development, provides a means for generating red channel (causer) generated green channel (receiver) specific IIE by imagewise consumption of the magenta mask in the red sensitized layer. As discussed shortly, however, this strategy is not without serious limitations.

Another tactic used to address desired directed causer/receiver response is to employ 'color contamination' to compensate for undesired causer/unintended receiver response. In this scenario, a colorless coupler that generates a dye of identical or similar hue to that formed in the unintended receiver, is coated in the causer layer. In principle, by balancing the amount of color contamination coupler coated, a dye scale complementary to the inhibition scale can be used to compensate for the undesired IIE. In the example above, coating a yellow dye forming coupler in the red-sensitized layer could offer relief of the undesired red→blue IIE. However, in practice, this approach is far from satisfactory. At a minimum, some specific proportion of captured red light is redirected toward producing yellow, rather than cyan dye, reducing the efficiency of the red record to record channel specific information.

Equally important to the use of high IIE to enhance color quality is the ability to generate a constant, exposure independent level of targeted cause/desired receiver response. In addition to extending the effective latitude of the capture media, this requirement minimizes saturation and hue fluctuations across the luminance range captured in and common to most uncontrolled lighting situations. Failure to provide constant IIE relationships can affect both hue rendition as well as saturation, particularly if there is a different exposure relationship or sensitivity for the desired and undesired IIE. In many cases, both color contamination and/or colored coupler technology may provide an exposure explicit effect, but vary considerably as exposure varies. It is common for pictures to be over- or under-exposed and it is desired that the color rendition be, nevertheless, accurate.

One of the more difficult IIE relationships necessary for high color quality reproduction of the original scene is blue→green (desired receiver) IIE. In practice, DIR technology in the blue sensitized record operates to generate both the desired interaction as well as blue→red (undesired receiver) IIE. This is particularly troublesome when pursuing very aggressive levels of the desired blue record/green record effect. Similarly, with a traditional layer ordering placement of the blue, green and red sensitive elements with respect to incident exposure, it is not uncommon to observe significant exposure dependencies of both the desired and undesired IIE. This spatial relationship of incoming light having to pass through the blue record before affecting the green sensitive imaging layer also precludes the use of a magenta-colored coupler used in the blue sensitized record to evoke more site specific, desired IIE. Since spectral information utilized by the green record would be unproductively consumed in the blue channel, this strategy, while potentially effective for color management, would lead to an unacceptably high loss in image efficiency. Further, use of 'color contamination' where a cyan-dye-forming coupler is used to compensate for the yellow dye forming DIR's traditionally employed in the blue record suffer from several limitations, including both inefficient use of blue channel specific scene information and difficulties in producing an effective profile in the contaminating dye with respect to exposure.

As such, although the art has made strides toward improving the interimage effects caused by the blue layers, further improvements are desired. A problem to be solved is to provide a color negative element exhibiting improved consistency, as a function of exposure level, of B→R and B→G interimage effects without sacrificing blue density.

SUMMARY OF THE INVENTION

The invention provides a photographic element comprising a support bearing a blue light sensitive record containing at least three layers having different levels of light sensitivity arranged in the order slowest to fastest with the slowest layer closest to the support and the fastest layer closest to the light exposure source, wherein:

a) all of the blue-sensitive layers are closer to the light exposure source than the layers sensitive to any other color, b) the slowest blue light sensitive layer is at least 1.0 log E slower than the next fastest blue light sensitive layer when measured at a density of 0.15 above Dmin, and contains a cyan dye-forming development inhibitor releasing (DIR) coupler represented by $DIR_1$;

$$DIR_1=Coup_1\text{-Time-}Inh_1$$

wherein $Coup_1$ is a coupler nucleus that releases -Time-$Inh_1$ and forms a cyan dye upon reaction with oxidized developer, Time is a group that permits -Time-$Inh_1$ to be cleaved from $Coup_1$ and to diffuse within the photographic element during development processing and is thereafter cleaved from $Inh_1$ and $Inh_1$ is an inhibitor group of high strength capable of inhibiting the development of a silver halide emulsion upon release from Time;

c) all of the blue light sensitive layers other than the slowest blue light sensitive layer independently contain a yellow dye-forming DIR coupler represented by $DIR_2$:

$$DIR_2=Coup_2\text{-}Inh_2$$

wherein $Coup_2$ is a coupler nucleus that releases -$Inh_2$ and forms a yellow dye upon reaction with oxidized developer during development processing, and $Inh_2$ is an inhibitor group capable of inhibiting the development of a silver halide emulsion other than one qualifying as a high strength inhibitor.

The invention also provides a process for forming an image in the element of the invention.

Embodiments of the invention provide improved color rendition without sacrificing blue density.

DETAILED DESCRIPTION OF THE INVENTION

Figure 1:
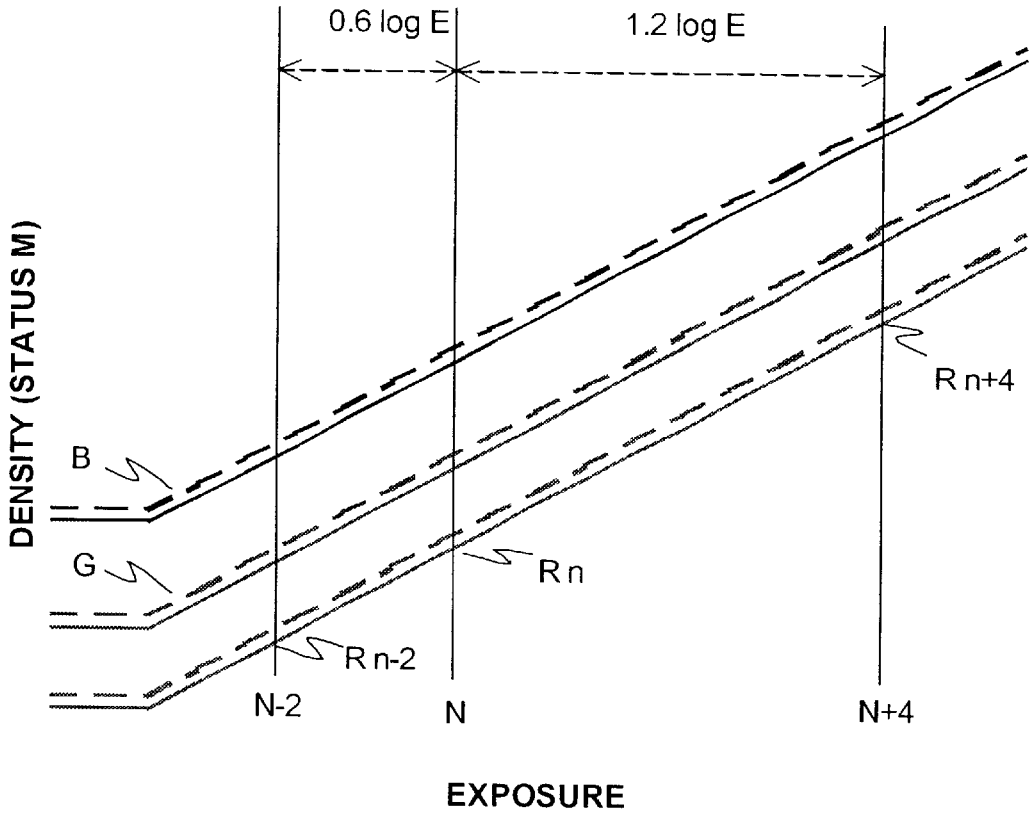
FIG. 1 is a graph showing coextensive characteristic curves for the color records of a color photographic element.

The invention is as generally described above. The photographic elements are multicolor elements. Multicolor elements contain image dye-forming units sensitive to each of the three primary regions of the spectrum. Each unit besides the blue unit can comprise a single emulsion layer or multiple emulsion layers sensitive to a given region of the spectrum. The layers of the element, including the layers of the image-forming units, can be arranged in various orders as known in the art.

A typical multicolor photographic element of the invention comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least three blue-sensitive silver halide emulsion layers having associated therewith at least one yellow dye-forming coupler. The element can contain additional layers, such as filter layers, interlayer, overcoat layers, and subbing layers.

The number of blue light sensitive layers is at least three. This is needed to maintain the desired level of consistency of IIE over the range of potential exposures. More than three layers may be employed but three is sufficient for consistency in most instances. The layers are arranged in the most common arrangement for a multilayer photographic element. The layers are arranged in order of increasing speed going from the support to the light exposure source. Typically the three or more layers are contiguous to permit improved image quality from the standpoint, for example, of granularity.

The blue light sensitive layers are all closer to the light exposure source than the light sensitive layers of any other color. It is desired that there be at least three layers comprising the green and red records to achieve high image quality. The slowest of the blue sensitive layers contains a cyan dye-forming development inhibitor releasing (DIR) coupler having formula $DIR_1$:

$$DIR_1=Coup_1\text{-Time-}Inh_1.$$

$Coup_1$ is any coupler nucleus capable of combining with an oxidized color developing agent to form a cyan colored dye. Representative examples of Coup groups contained in couplers useful for forming dyes in elements of the invention are as follows, with the groups 1A and 1B being employed for yellow dye-forming couplers, 1C through 1F being suitable for magenta couplers and 1G to 1K being suitable for cyan couplers. $Coup_1$ is suitably represented by a pyrolotriazole as shown in U.S. Pat. No. 5,256,526, or by formula 1G through 1K, particularly, 1H or 1I.

1A

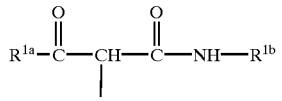

1B

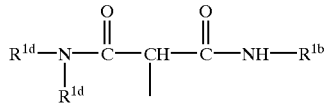

1C

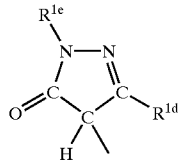

1D

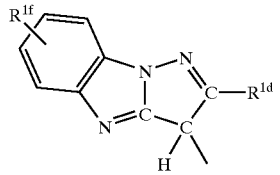

1E

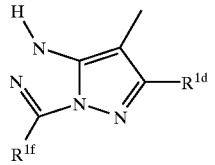

-continued

1F

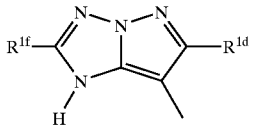

1G

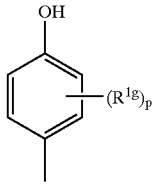

1H

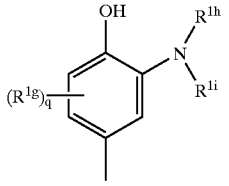

1I

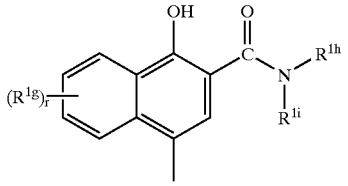

1J

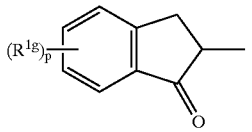

1K

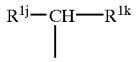

A free bond from the coupling site in the above formulae indicates a position to which the coupling release group or coupling-off group is linked. In the above formulae, when $R^{1a}$, $R^{1b}$, $R^{1c}$, $R^{1d}$, $R^{1e}$, $R^{1f}$, $R^{1g}$, $R^{1h}$, $R^{1i}$, $R^{1j}$, or $R^{1k}$ contains a ballast or antidiffusing group, it is selected so that the total number of carbon atoms is from 8 to 32 and preferably from 10 to 22.

$R^{1a}$ represents an aliphatic- or alicyclic hydrocarbon group, an aryl group, an alkoxyl group, or a heterocyclic group, and $R^{1b}$ and $R^{1c}$ each represents an aryl group or a heterocyclic group.

The aliphatic- or alicyclic hydrocarbon group represented by $R^{1a}$ preferably has at most 22 carbon atoms, may be substituted or unsubstituted, and aliphatic hydrocarbon may be straight or branched. Preferred examples of the substituent for these groups represented by $R^{1a}$ are an alkoxy group, an aryloxy group, an amino group, an acylamino group, and a halogen atom. These substituents may be further substituted with at least one of these substituents repeatedly. Useful examples of the groups as $R^{1a}$ include an isopropyl group, an isobutyl group, a tert-butyl group, an isoamyl group, a tert-amyl group, a 1,1-dimethyl-butyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido)isopropyl group, an α-(phthalimido)isopropyl group, an α-(benzenesulfonamido)isopropyl group, and the like.

When $R^{1a}$, $R^{1b}$, or $R^{1c}$ is an aryl group (especially a phenyl group), the aryl group may be substituted. The aryl group (e.g., a phenyl group) may be substituted with groups having not more than 32 carbon atoms such as an alkyl group, an alkenyl group, an alkoxy group, an alkoxycarbonyl group, an alkoxycarbonylamino group, an aliphatic- or alicyclic-amido group, an alkylsulfamoyl group, an alkylsulfonamido group, an alkylureido group, an aralkyl group and an alkyl-substituted succinimido group. This phenyl group in the aralkyl group may be further substituted with groups such as an aryloxy group, an alyloxycarbonyl group, an arylcarbamoyl group, an arylamido group, an arylsulfamoyl group, an arylsulfonamido group, and an arylureido group.

The phenyl group represented by $R^{1a}$, $R^{1b}$, or $R^{1c}$ may be substituted with an amino group which may be further substituted with a lower alkyl group having from 1 to 6 carbon atoms, a hydroxyl group, —COOM and —$SO_2M$ (M=H, an alkali metal atom, $NH_4$), a nitro group, a cyano group, a thiocyano group, or a halogen atom.

$R^{1a}$, $R^{1b}$, or $R^{1c}$ may represent substituents resulting from condensation of a phenyl group with other rings, such as a naphthyl group, a quinolyl group, an isoquinolyl group, a chromanyl group, a coumaranyl group, and a tetrahydronaphthyl group. These substituents may be further substituted repeatedly with at least one of above-described substituents for the phenyl group represented by $R^{1a}$, $R^{1b}$ or $R^{1c}$.

When $R^{1a}$ represents an alkoxy group, the alkyl moiety of the alkoxyl group can be a straight or branched alkyl group, an alkenyl group, a cycloalkyl group, or a cycloalkenyl group each having at most 32 carbon atoms, preferably at most 22 carbon atoms. These substituents may be substituted with groups such as halogen atom, an aryl group and an alkoxyl group to form a group having at most 32 carbon atoms.

When $R^{1a}$, $R^{1b}$, or $R^{1c}$ represents a heterocyclic ring, the heterocyclic group is linked to a carbon atom of the carbonyl group of the acyl group in α-acylacetamido or to a nitrogen atom of the amido group through one of the carbon atoms constituting the ring. Examples of such heterocyclic rings are thiophene, furan, pyran, pyrrole, pyrazole, pyridine, pyrazine, pyrimidine, pyridazine, indolizine, imidazole, thiazole, oxazole, triazine, thiadiazine and oxazine. These groups may further have a substituent or substituents in the ring thereof. Examples of the substituents include those defined for the aryl group represented by $R^{1a}$, $R^{1b}$ and $R^{1c}$.

In formula (1C), $R^{1e}$ is a group having at most 32 carbon atoms, preferably at most 22 carbon atoms, and it is a straight or branched alkyl group (e.g., a methyl group, an isopropyl group, a tert-butyl group, a hexyl group and a dodecyl group), an alkenyl group (e.g., an allyl group), a cycloalkyl group (e.g., a cyclopentyl group, a cyclohexyl group and a norbornyl group), an aralkyl group (e.g., a benzyl group and a β-phenylethyl group), or a cycloalkenyl group (e.g., a cyclopentenyl group and a cyoloalkenyl group). These groups may be further substituted with groups such as a halogen atom, a nitro group, a cyano group, an aryl group, an alkoxyl group, an aryloxy group, —COOM (M=H, an alkali metal atom, $NH_4$) an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamide group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxyl group, and a mercapto group.

Furthermore $R^{1e}$ may represent an aryl group (e.g., a phenyl group and an α- or β-naphthyl group). This aryl group may be substituted with at least one group. Examples of such substituents are an alkyl group, an alkenyl group, a cycloalkyl group, an aralkyl group, a cycloalkenyl group, a halogen atom, a nitro group, a cyano group, an aryl group, an alkoxy group, an aryloxy group, —COOM (M=H, an alkali metal atom, $NH_4$), an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, alkylsulfonyl group, an arylthio group, an alkylthio group, an alkylamino group, a dialkylamino group, an anilino group, an N-alkylanilino group, an N-arylanilino group, an N-acylanilino group, a hydroxyl group, and a mercapto group. More preferred as $R^{1e}$ is a phenyl group which is substituted with at least one of the groups such as an alkyl group, an alkoxyl group, and a halogen atom in at least one ortho-position, beeause it decreases color formation due to light or heat of the coupler remaining in a film member.

Furthermore, $R^{1e}$ may represent a heterocyclic group (e.g., 5- or 6-membered heterocyclic rings and condensed heterocyclic groups containing at least one hetero atom i.e., a nitrogen atom, an oxygen atom or a sulfur atom such as a pyridyl group, a quinolyl group, a furyl group, a benzothiazolyl group, an oxazolyl group, an imidazolyl group, and a naphthooxazolyl group), a heterocyclic group substituted with a group as listed for the above aryl group represented by $R^{1e}$, an aliphatic, alicyclic or aromatic acyl group, an alkylsulfonyl group, an arysulfonyl group, an alkylcarbarmoyl group, an arylcarbamoyl group, an alkylthiocarbanoyl group or an arylthiocarbamoyl group.

$R^{1d}$ represents a hydrogen atom, and represents groups having at most 32 carbon atoms, preferably at most 22 carbon atoms, such as a straight or branched alkyl group, an alkenyl group, a cycloalkyl group, an aralkyl group, a cycloalkenyl group (these groups may have a substituent or substituents as listed for $R^{1e}$), an aryl group, a heterocyclic group (these groups may have a substituent or substituents as listed for $R^{1e}$ an alkoxycarbonyl group (e.g., a methoxycarbonyl group, an ethoxycarbonyl group, and a stearyloxycarbonyl group), an aryloxycarbonyl group (e.g., a phenoxycarbonyl group and a naphthoxycarbonyl group), an aralkyloxycarbonyl group (e.g., a benzyloxycarbonyl group), an alkoxy group (e.g., a methoxy group, an ethoxy group, and a heptadecyloxy group), an aryloxy group (e.g., a phenoxy group and a tolyloxy group), an alkylthio group (e.g., an ethylthio group and a dodecylthio group), an arylthio group (e.g., a phenylthio group and an (α-naphthylthio group), —COOM(M=H alkali metal atom $NH_4$), an acylamino group e.g., an acetylamino group and a 3-[(2,4-di-tert-amylphenoxy)acetamido]benzamido group), a diacylamino group, an N-alkylacylamino group (e.g., an N-methylpropionamido group), an N-arylacylamino group (e.g., an N-phenylacetamido group), a ureido group, a substituted ureido group (e.g., an N-arylureido group, and an N-alkylureido group), a urethane group, a thiourethane group, an arylamino group (e.g., a phenylamino group, an N-methylanilino group, a di-phenylamino group, an N-acetylanilino group, and a 2-chloro-5-tetradecaneamidoanilino group), an alkylamino group (e.g., an n-butylamino group, a methylamino group and a cyclohexylamino group), a cycloamino group (e.g., a piperidino group, and a pyrrolidino group), a heterocyclic amino group (e.g., a 4-pyridylamino group and a 2-benzooxazolidyl amino group), an alkylcarbonyl group (e.g., a methylcarbonyl group), an arylcarbonyl group (e.g., a phenylcarbonyl group), a sulfonamido group (e.g., an alkylsulfonamido group and an arylsulfonamido group), a carbamoyl group (e.g., an ethylcarbamoyl group, a dimethylcarbamoyl group an N-methyl-N-phenylcarbamoyl group and an N-phenylcarbamoyl group), a sulfamoyl group (e.g., an N-alkylsulfamoyl group, an N,N-dialkylsulfamoyl group, an N-arylsulfamoyl, an N-alkyl-N-arylsulfamoyl group, and an N,N-diarylsulfanoyl group), a cyano group, a hydroxyl group, a mercapto group, a halogen atom, or a sulfo group.

$R^{1f}$ represents a hydrogen atom, and represents groups having at most 32 carbon atoms, preferably at most 22 carbon atoms, such as a straight or branched alkyl group, an alkenyl group, a cycloalkyl group, an aralkyl group, or a cycloalkenyl group. These groups may be substituted with a group or groups as listed for $R^{1e}$.

$R^{1f}$ may be an aryl group or a heterocyclic group. These groups may be substituted with a group or groups as listed for $R^{1e}$.

$R^{1f}$ may be a cyano group, an alkoxyl group, an aryloxy group, a halogen atom, —COOM(M=H, an alkali metal atom, $NH_4$), an alkoxycarbonyl group, an aryloxycarbonyl group, an acyloxy group, a sulfo group, a sulfamoyl group, a carbarmoyl group, an acylamino group, a diacylamino group, a ureido group, a urethane group, a sulfonamido group, an arylsulfonyl group, an alkylsulfonyl group, an uiylthio group, an alkylthio group, an alkylamino group, a dialkylamino group, an anilino group, an N-aryl-anilino group, an N-alkylanilino group, an N-acylanilino group, a hydroxyl group, or a mercapto group.

$R^{1g}$, $R^{1h}$, $R^{1i}$ each represents a group as is conventionally used in 4-equivalent phenol or α-naphthol couplers $R^{1g}$, $R^{1h}$ and $R^{1i}$ each may have at most 32 carbon atoms, and preferably at most 22 carbon atoms.

More specifically, $R^{1g}$ represents a hydrogen atom, a halogen atom, an alkoxycarbonylamino group, an aliphatic or alicyclic-hydrocarbon group, an N-arylureido group, an acylamino group, a group —$R^{1l}$ or a group —S—$R^{1l}$ (wherein $R^{1l}$ is an aliphatic- or alicyclic-hydrocarbon radical). When two or more of the groups of $R^{1g}$ are contained in one molecule they may be different, and the aliphatic- and alicyclic-hydrocarbon radical may be substituted. In a case that these substituents contain an aryl group, the aryl group may be substituted with a group or groups as listed for $R^{1e}$.

$R^{1h}$ and $R^{1i}$ each represents a group selected from an aliphatic- or alicyclic-hydrocarbon radial, an aryl group, and a heterocyclic group, or one of $R^{1h}$ and $R^{1i}$ may be hydrogen atom. The above groups may be substituted. $R^{1h}$ and $R^{1i}$ may combine together to form a nitrogen-containing heterocyclic nucleus.

The aliphatic- and alicyclic-hydrocarbon radical may be saturated or unsaturated, and the aliphatic hydrocarbon may be straight or branched. Preferred examples are an alkyl group (e.g., a methyl group, an ethyl group, an isopropyl group, a butyl group, a tert-butyl group, an isobutyl group, a dodecyl group, an octadecyl group, a cyclobutyl group and a cyclohexyl group), and an alkenyl group (e.g., an alkyl group and an octenyl group). Typical examples of the aryl group are a phenyl group and a naphthyl group, and typical examples of the heterocyclic radical are a pyridinyl group, a quinolyl group, a thienyl group, a piperidyl group, and an imidazolyl group. Groups to be introduced in these aliphatic hydrocarbon radical, aryl group and heterocyclic radical include a halogen atom, a nitro group, a hydroxyl group, a carboxyl group, an amino group, a substituted amino group, a sulfo group, an alkyl group, an alkenyl group, an aryl group, a heterocyclic group, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group, and a morpholino group.

p is an integer of 1 to 4, q is an integer of 1 to 3, and r is an integer of 1 to 5.

$R^{1j}$ represents a group having at most 32 carbon atoms and preferably at most 22 carbon atoms. $R^{1j}$ represents an arylcarbonyl group, an alkanoyl group, an alkanecarbamoyl group, an alkoxycarbonyl group, or an aryloxycarbonyl group. These groups may be substituted with groups such as an alkoxyl group, an alkoxycarbonyl group, an acylamino group, an alkylsulfamoyl group, an alkylsulfonamido group, an alkylsuccinimide group, a halogen atom, a nitro group, a carboxyl group, a nitrile group, an alkyl group, and an aryl group.

$R^{1k}$ represents groups having at most 32 carbon atoms, and preferably at most 22 carbon atoms. $R^{1k}$ represents an arylcarbonyl group, an alkamoyl group, an arylcarbamoyl group, an alkanecarbamoyl group, an alkoxycarbonyl group, and aryloxycarbonyl group, and arylsulfonyl group, an arylsulfonyl group, an aryl group, or a 5- or 6-membered heterocyclic group (containing a hetero atom selected from a nitrogen atom, an oxygen atom, and a sulfur atom, e.g., a triazolyl group, an imidazolyl group, a phthalamido group, a succinamido group, a furyl group, a pyridyl group, and a benzotriazolyl group). These groups may be substituted with a group or groups as listed for $R^{1j}$.

The above described substituted groups in formulae 1A–1K may be further substituted repeatedly once, twice or more with a group selected from the same group of the substituents to form substituted groups having preferably at most 32 carbon atoms.

The group TIME is a group that is cleaved from $Coup_1$ along with $Inh_1$ during development processing. This group produces the time-delayed release of the inhibitor typically using an intramolecular nucleophilic substitution reaction (U.S. Pat. No. 4,248,962); an electron transfer reaction along a conjugated system (U.S. Pat. Nos. 4,409,323; 4,421,845; 4,861,701, Japanese Applications 57-188035; 58-98728; 58-209736; 58-209738); or a coupling or reducing agent reaction after the coupler reaction (U.S. Pat. No. 4,438,193; U.S. Pat. No. 4,618,571). Groups may combine the features describe above. It is typical that Time-$Inh_1$ is of one of the formulas:

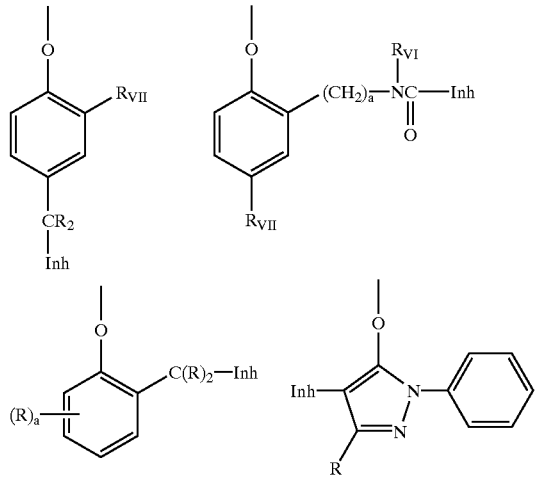

-continued

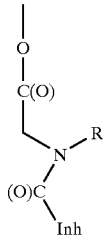

wherein Inh is the inhibitor moiety $Inh_1$ each R is H or a substituent, a is 1 to 4, $R_{VII}$ is selected from the group consisting of nitro, cyano, alkylsulfonyl; sulfamoyl; and sulfonamido groups, a is 0 or 1, and $R_{VI}$ is selected from the group consisting of substituted and unsubstituted alkyl and phenyl groups. The oxygen atom of each timing group is bonded to the coupling-off position of the respective $Coup_1$ moiety of the DIR coupler. See U.S. Pat. Nos. 5,021,322 and 5,670,301 for further detailed explanations of the last two groups.

The Time group may function by electron transfer down an unconjugated chain. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Examples of typical inhibitor moieties useful generally in DIR couplers are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. Typical example may be selected from the following formulas:

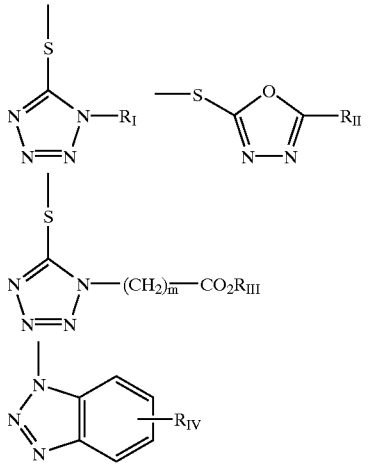

-continued

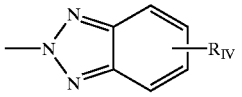

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

$Inh_1$ in the invention is an inhibitor of high strength. Such groups are selected from the groups consisting of mercaptotetrazoles, mercaptotriazoles, mercaptothiadiazoles, mercaptooxadiazole, mercaptooxazoles, tetrazoles (such as those with a thioether substituent, or those with an alkoxyphenyl subsitutent ), and benzotriazoles. In order to qualify as a "high strength" inhibitor, the inhibitor must have a Calculated Log P as shown in Table I. It is preferred that such groups have a pKsp value as shown below, as well.

Because it can be difficult to measure log P values above 3, a model can be used to compute an estimate of log P, called Calculated log P. For the purposes of this invention, Calculated log P are calculated using KowWin version 1.66 or later versions of the software, available from Syracuse Research Corporation, Syracuse, N.Y. (esc.syrres.com). If this software is unavailable, the applicant will furnish to interested third parties the Calculated log P values for any specific materials.

KowWin also has the ability to improve modeling of unknown structures by adding experimental data related to a structurally related material.

Some structures can be drawn in multiple tautomeric forms. For the purposes of the invention, the Calculated log P is to be computed for the tautomer whose heterocyclic nucleus experimentally predominates in an aqueous fluid environment at room temperature. Moreover, for the purposes of this invention, the Calculated log P refers to neutral monomeric molecules, even if they would be ionized or protonated (either fully or in part) at the processing pH or at the ambient pH of the photographic film. For example, in the case of benzotriazole monomers in which the N—H is temporarily blocked with a removable group, Calculated log P should be calculated based on the monomer with the free N—H bond.

The preferred properties for subclasses of such groups are generally shown below.

TABLE I

| Inhibitor Type | pKsp | Calc Log P |
|---|---|---|
| mercaptotetrazoles | >13 | 3–5 |
| mercaptotriazoles | >13 | 3–5 |
| mercaptothiadiazoles | >13 | 3–5 |
| mercaptooxadiazoles | >13 | 3–5 |
| mercaptooxazoles | >13 | 3–5 |
| Alkoxyphenyl substituted tetrazoles | >13 | >2.5 |
| Thioether substituted triazoles | >13 | 2.5–4.5 |
| Ester subsituted benzotriazoles, | >13 | 2.3–3 |
| Di-alkoxy substituted benzotriazoles | >13 | >2.5 |

TABLE I-continued

| Inhibitor Type | pKsp | Calc Log P |
|---|---|---|
| Amido substituted benzotriazoles | >13 | 3–5 |
| -SR substituted benzotriazoles | >13 | 2.5–5 |

Examples of useful $DIR_1$ couplers that satisfy high strength inhibitor groups $Inh_1$ are:

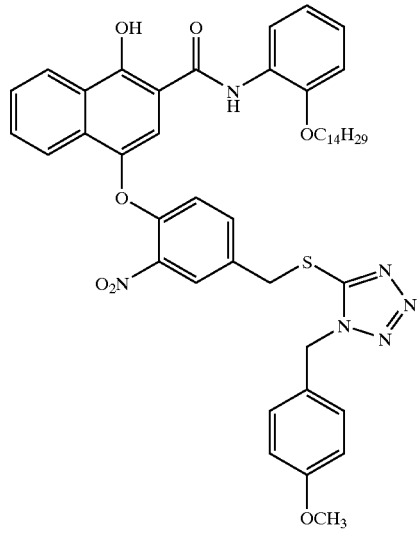

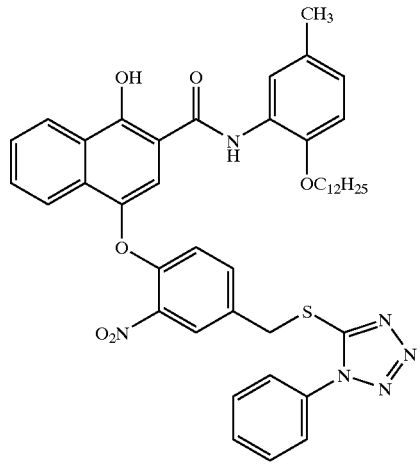

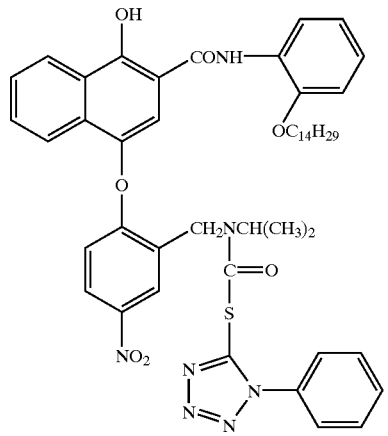

-continued

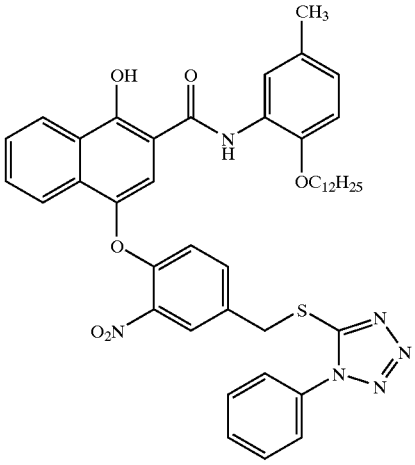

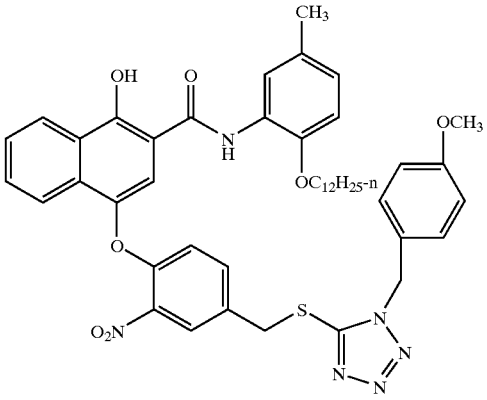

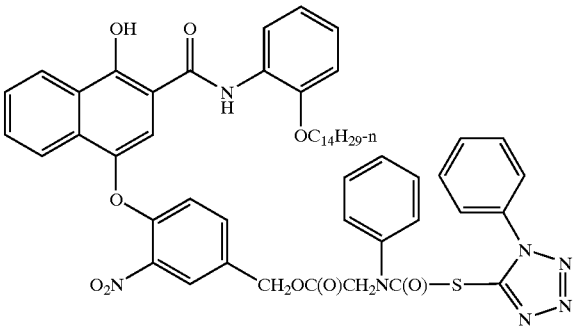

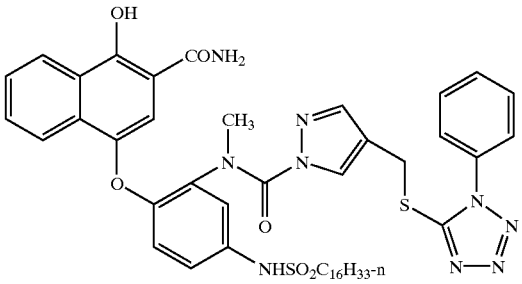

The invention element is designed to have the slowest blue light sensitive layer to be at least 1.0 log E slower than the next fastest blue light sensitive layer. This insures that this inhibitor will have an effect primarily in the high exposure areas and have the effect of balancing B→R and B→G IIE.

The blue sensitive layers other than the slowest of the blue sensitive layers contains a yellow dye-forming development inhibitor releasing (DIR) coupler having formula $DIR_2$:

$$DIR_2=Coup_2\text{-}Inh_2.$$

$Coup_2$ is any coupler nucleus capable of combining with an oxidized color developing agent to form a yellow colored dye. Representative examples of Coup groups contained in couplers useful for forming dyes in elements of the invention are those shown earlier as Coups of formulas 1A and 1B. $Coup_2$ groups are exemplified by acylacetanilide groups such as pivaloyl and benzoylacetanilide groups as well-known in the art.

The $Inh_2$ group is an inhibitor group that does not qualify as a high strength inhibitor, as defined above. Examples of such inhibitor groups are the following:

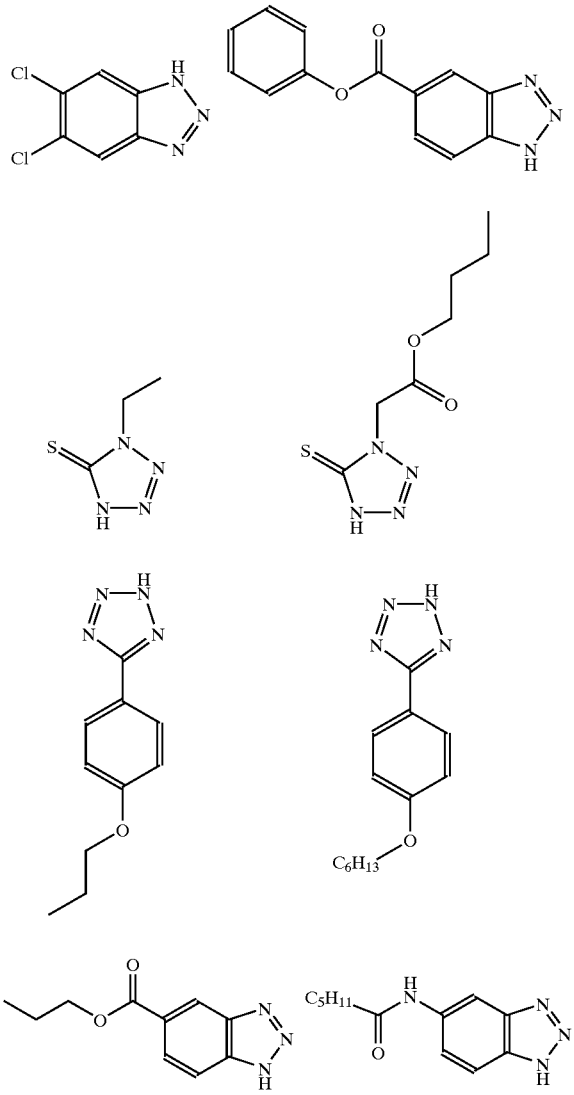

Examples of $DIR_2$ couplers are the following:

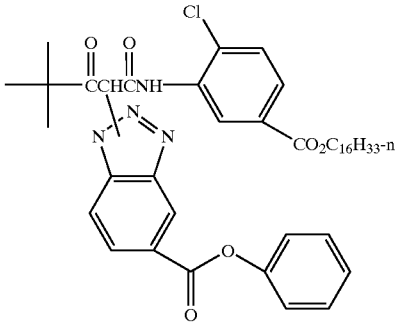

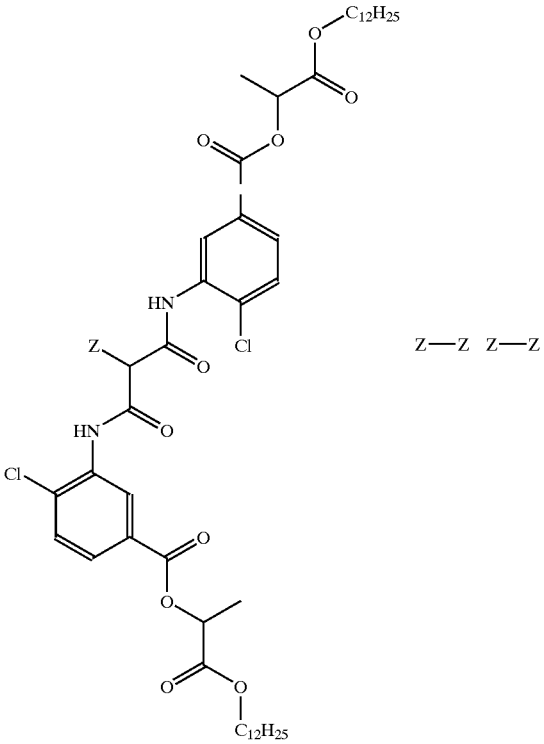

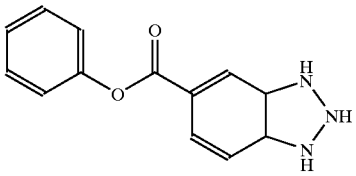

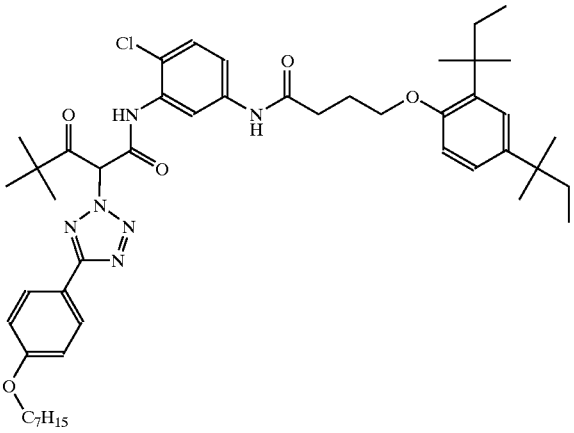

-continued

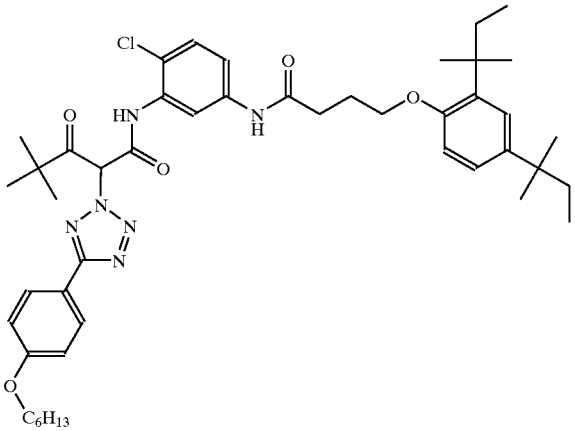

Unless otherwise specifically stated, use of the term "group", "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro, hydroxyl; cyano, carboxyl, or groups which may be further substituted, such as alkyl, including straight or branched chain or cyclic alkyl, such as methyl, trifluoromethyl, ethyl, t-butyl, 3-(2,4-di-t-pentylphenoxy) propyl, cyclohexyl, and tetradecyl; alkenyl, such as ethylene, 2-butene, alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy, aryl such as phenyl, 4-t-butylphenyl, 2,4,6-trimethylphenyl, naphthyl, aryloxy, such as phenoxy, 2-methylphenoxy, alpha- or beta-naphthyloxy, and 4-tolyloxy, carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-tolylcarbonylamino, N-methylureido, N,N-dimethylureido, N-methyl-N-dodecylureido, N-hexadecyl ureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethyl ureido, and t-butylcarbonamido, sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl, N-[3-(dodecyloxy)propyl]sulfamoyl, N-[4-(2,4-di-t-pentylphenoxy)butyl ]sulfamoyl, N-methyl-N-tetradecylsulfamoyl, and N-dodecylsulfamoyl, carbamoyl, such as N-ethylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylbexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, and releasing or releasable groups. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

The materials useful in the invention can be used in any of the ways and in any of the combinations known in the art. Typically, the invention materials are incorporated in a melt and coated as a layer described herein on a support to form part of a photographic element. When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1996, Item 38957, available as described above, which is referred to herein by the term "Research Disclosure". The Sections hereinafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical properly modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, and color correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293, 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305; 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777, and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652, 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841; EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474; 5,405,737; 5,411,848, 5,427,898, EPO 0 327 976; EPO 0 296 793; EPO 0 365 282; EPO 0 379 309; EPO 0 415 375; EPO 0 437 818, EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213,490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use in association with nucleating agents, development accelerators or their precursors (UK. Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the materials useful in the invention may be blocked or coated in protected form as described, for example, in Japanese Application 61/258,249 or U.S. Pat. No. 5,019,492.

The invention may further be used in combination with image-modifying compounds that release PUGS such as "Developer Inhibitor-Releasing" compounds (DIR's). DIR's useful in conjunction with the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634, 4,579,816; 4,607,004; 4,618,571; 4,678,739; 4,746,600; 4,746,601; 4,791,049; 4,857,447; 4,865,959; 4,880,342, 4,886,736; 4,937,179; 4,946,767; 4,948,716; 4,952,485; 4,956,269; 4,959,299, 4,966,835; 4,985,336 as well as in patent publications GB 1,560,240; GB 2,007,662, GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969). Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group.

Suitable developer inhibitor-releasing couplers for use in the present invention include, but are not limited to, the following:

D1

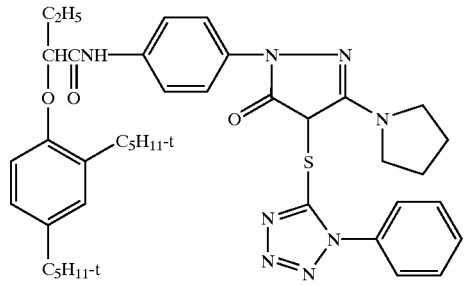

D2

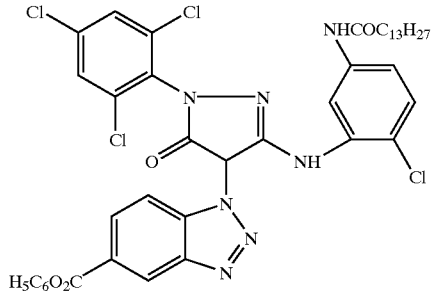

D3

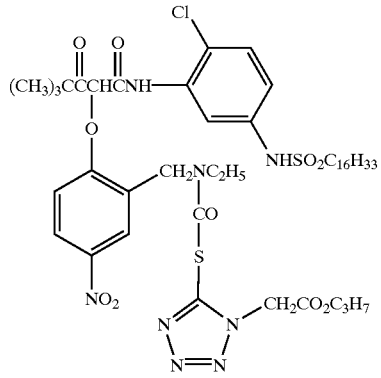

D4

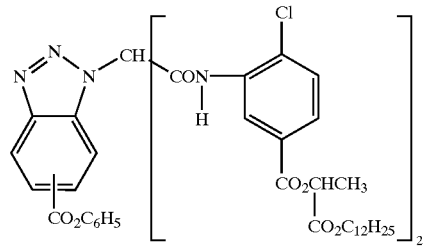

D5

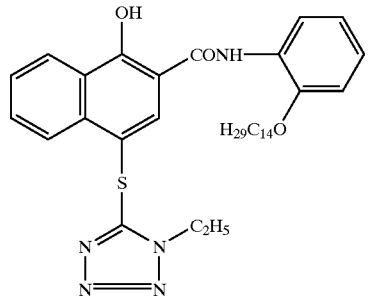

-continued

D6

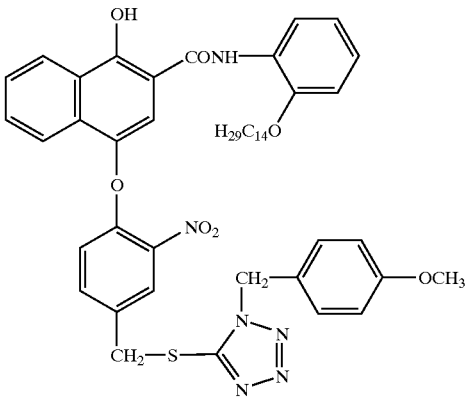

D7

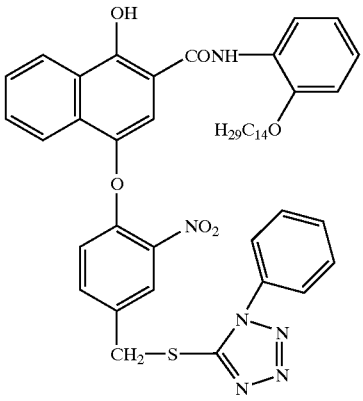

D8

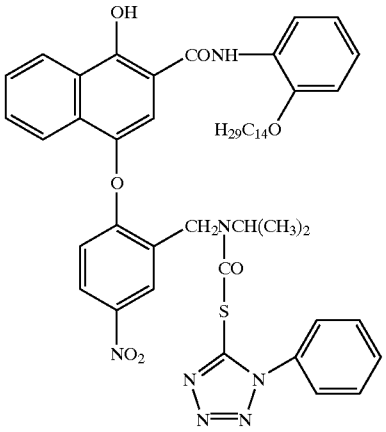

D9

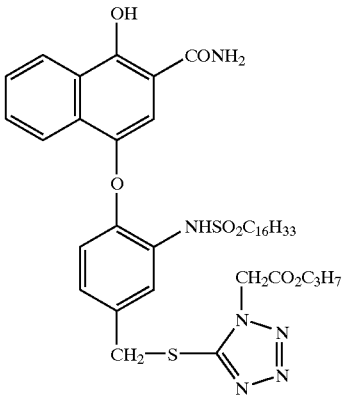

-continued

D10

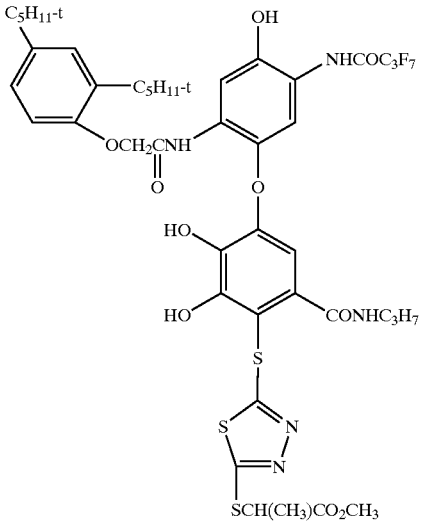

D11

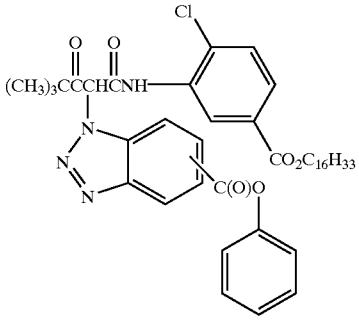

D12

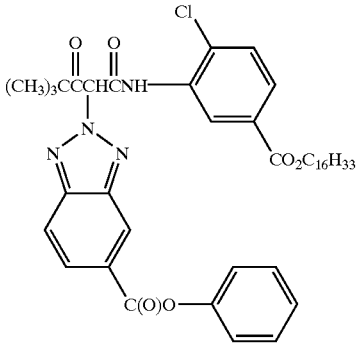

Conventional radiation-sensitive silver halide emulsions can be employed in the practice of this invention. Such emulsions are illustrated by *Research Disclosure*, Item 38755, September 1996, I. Emulsion grains and their preparation.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al U.S. Pat. Nos. 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yanashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color-developing agent to reduce developable silver halide and oxidize the color-developing agent. Oxidized color developing agent in turn reacts with the coupler to yield a dye. If desired "Redox Amplification" as described in Research Disclosure XVIIIB(5) may be used.

A "color negative element" utilizes negative-working silver halide and provides a negative image upon processing. A first type of such element is a capture element, which is a color negative film that is designed for capturing an image in negative form rather than for viewing an image. A second type of such an element is a direct-view element that is designed, at least in part, for providing a positive image viewable by humans.

In the capture element, speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3'15" or less and desirably 90 or even 60 seconds or less.

A direct-view photographic element is one which yields a color image that is designed for human viewing (1) by reflected light, such as a photographic paper print, (2) by transmitted light, such as a display transparency, or (3) by projection, such as a color slide or a motion picture print. These direct-view elements may be exposed and processed in a variety of ways. For example, paper prints, display transparencies, and motion picture prints are typically produced by digitally printing or by optically printing an image from a color negative onto the direct-viewing element and processing though an appropriate negative-working photographic process to give a positive color image. The element may be sold packaged with instructions for digital printing or for processing using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less. Color slides may be produced in a similar manner but are more typically produced by exposing the film directly in a camera and processing through a reversal color process or a direct positive process to give a positive color image. The foregoing images may also be produced by alternative processes such as digital printing.

Each of these types of photographic elements has its own particular requirements for dye hue, but in general they all require cyan dyes whose absorption bands are less deeply absorbing (that is, shifted away from the red end of the spectrum) than color negative films. This is because dyes in direct-view elements are selected to have the best appearance when viewed by human eyes, whereas the dyes in image capture materials are designed to best match the needs of the printing process.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal elements are typically sold packaged with instructions to process using a color reversal process such as the Kodak E-6 process as described in The British Journal of Photography Annual of 1988, page 194. Alternatively, a direct positive emulsion can be employed to obtain a positive image.

The above elements are typically sold with instructions to process using the appropriate method such as the mentioned color negative (Kodak C-41), color print (Kodak RA-4), or reversal (Kodak E-6) process.

The photographic element of the invention can be incorporated into exposure structures intended for repeated use or exposure structures intended for limited use, variously referred to by names such as "single use cameras", "lens with film", or "photosensitive material package units".

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

EXAMPLES

All coating coverages are reported in parenthesis in terms of g/m$^2$, except as otherwise indicated. Silver halide coating overages are reported in terms of silver. The symbol "M %" indicates mole percent. Equivalent Circular Diameter (ECD) and thickness (t) are reported as mean grain values in $\mu$m. Halides in mixed halide grains and emulsions are named in order of ascending concentrations. Gamma ($\gamma$) for each color record is the maximum slope of the characteristic curve between a point on the curve lying at a density of 0.15 above minimum density (Dmin) and a point on the characteristic curve at 0.9 log E higher exposure level, where E is exposure in lux-seconds.

Example Compounds

ADA-1

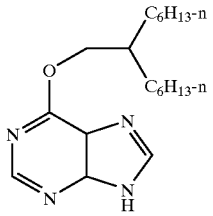

B-1

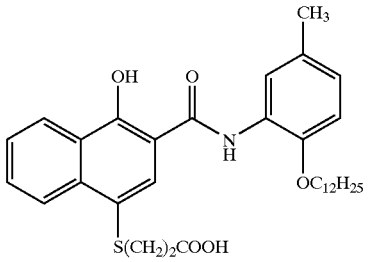

C-1

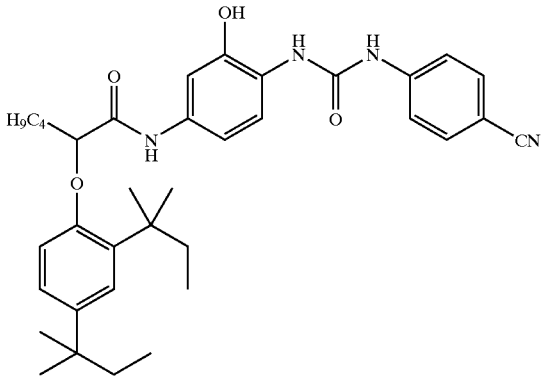

CD-1

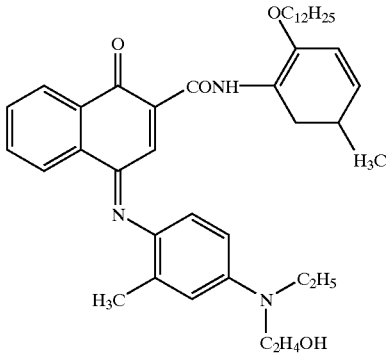

CD-2

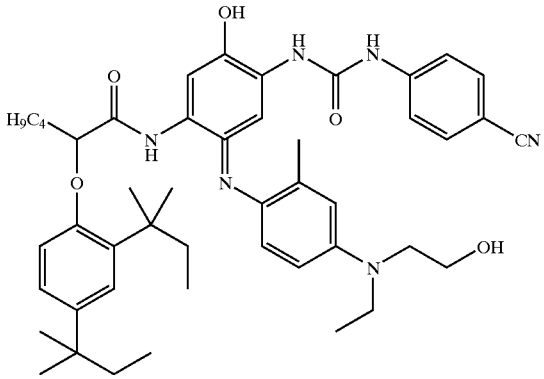

-continued
CM-1
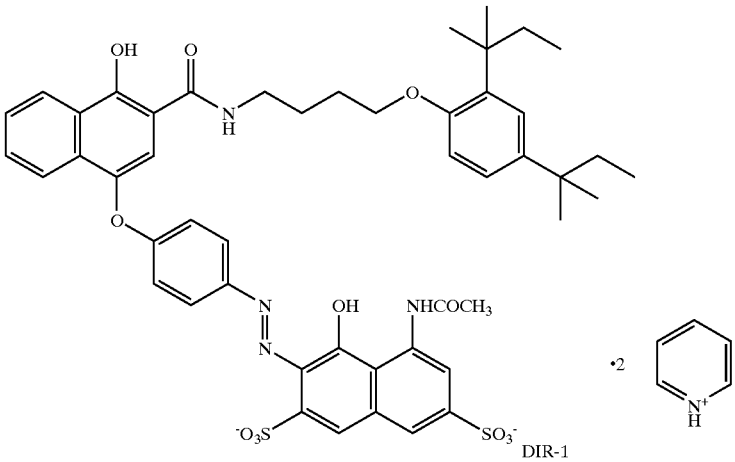
DIR-1
DIR-2
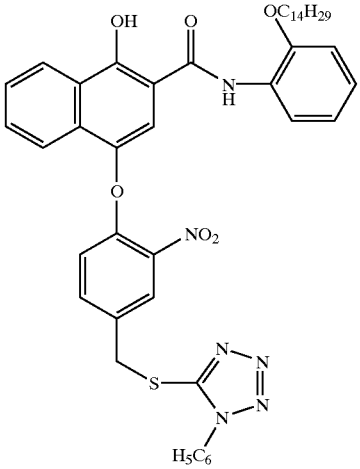
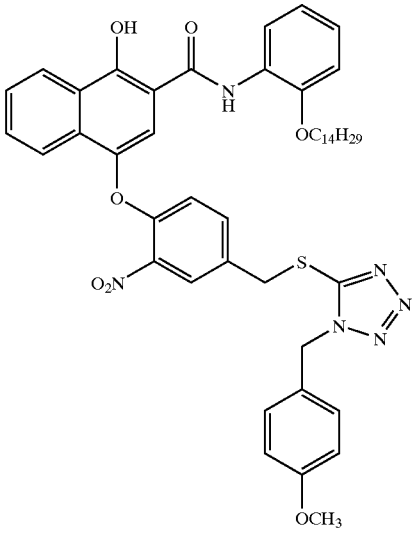
DIR-3
DIR-4
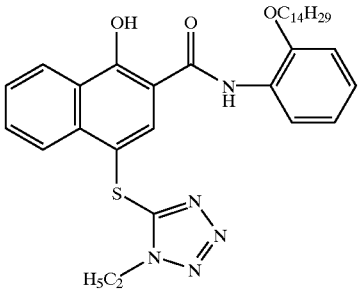
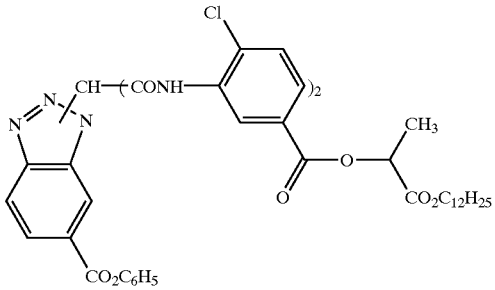
DIR-5
DIR-6
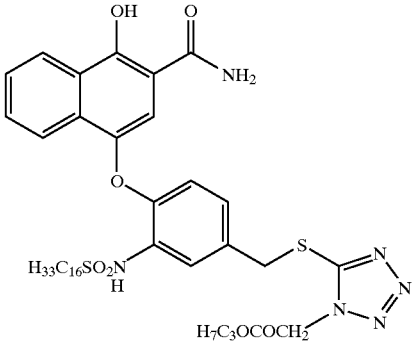
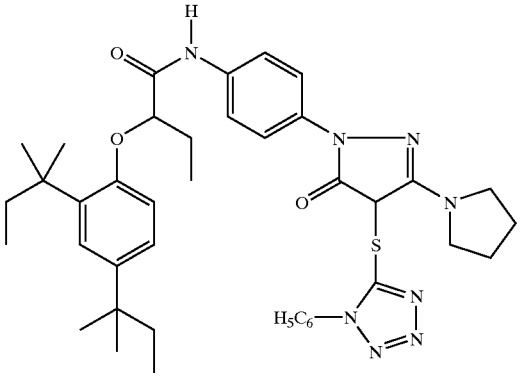

-continued
DIR-7
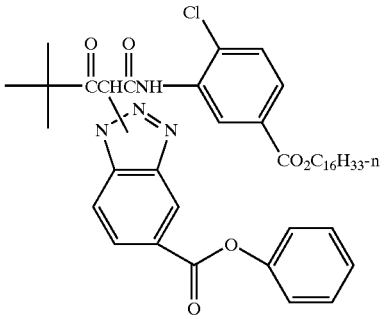
DIR-8
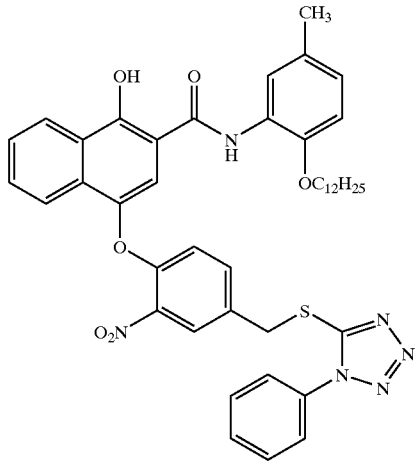
DIR-9
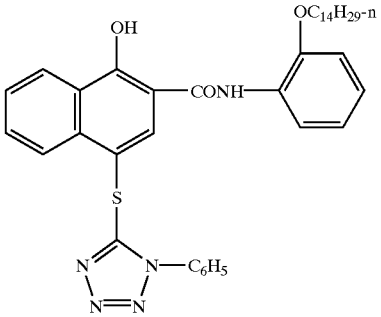
H-1
Bis(vinylsulfonyl)methane
M-1
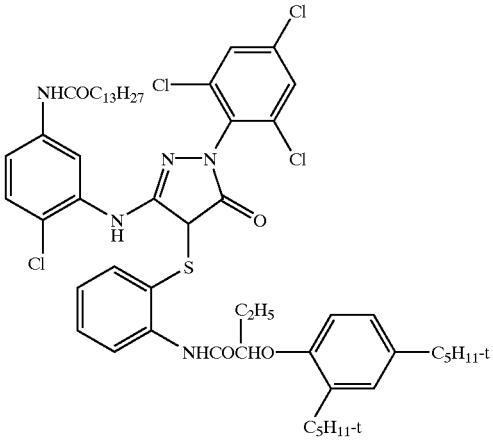
MD-1
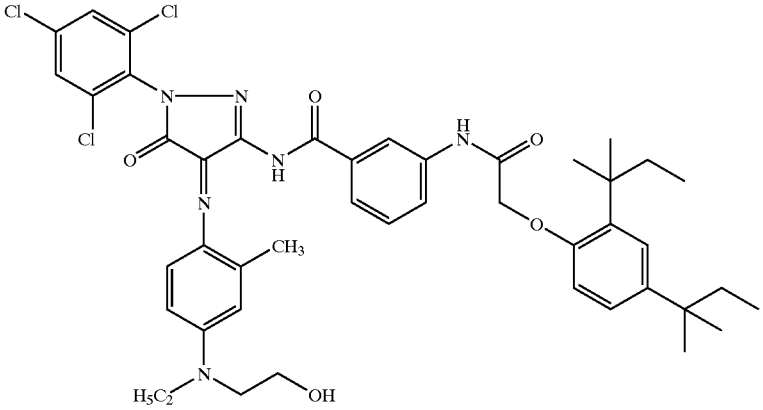

-continued
MM-1
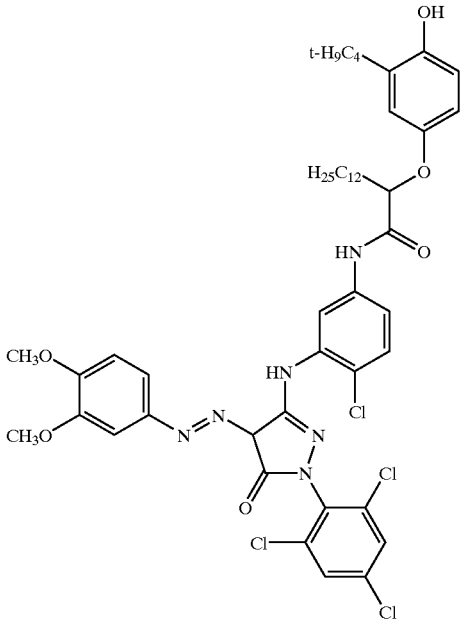
S-1
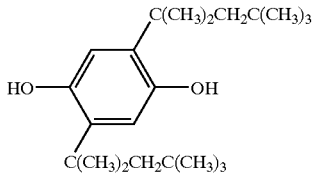
Y-1
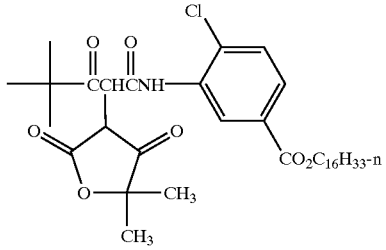
Y-2
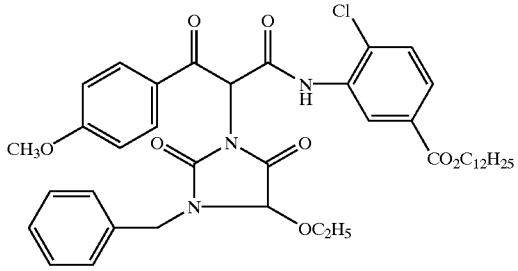
YD-1
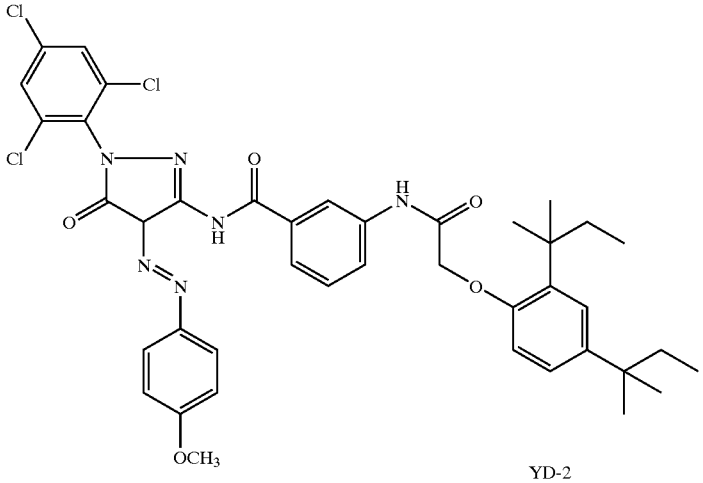
YD-2
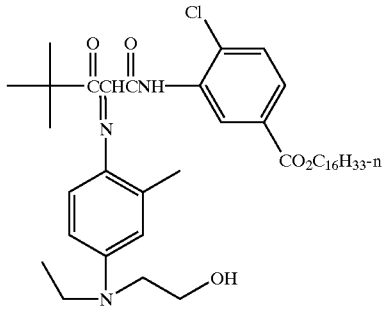
UV-1
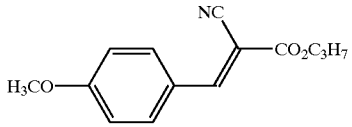

-continued

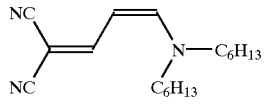

UV-2

Example 1

Effect of Double Coat vs. Triple Coat

The suffix (C) designates control or comparative color negative films, while the suffix (I) indicates examples containing the invention.

Sample 001: Comparison (Double Coat Comparison)

This sample was prepared by applying the following layers in the sequence recited to a transparent film support of annealed polyethylene naphthalate (APEN) with conventional subbing layers, with the red recording layer unit coated nearest the support. The side of the support to be coated had been prepared by the application of gelatin subbing.

| | mg/m$^2$ |
|---|---|
| Layer 1 | |
| (Antihalation layer) | |
| Black colloidal silver sol | 172 |
| Oxidized developer scavenger S-1 | 124 |
| Colored coupler CD-1 | 22 |
| Colored coupler MD-1 | 2 |
| Colored coupler YD-2 | 11 |
| Advanced development accelerator ADA-1 | 22 |
| gelatin | 1614.6 |
| Layer 2 | |
| (SC layer) This layer was comprised of a blend of a lower and higher sensitivity sensitized tabular silver iodobromide emulsions respectively containing 4.5 and 0.5% iodide | |
| AgIBr (0.70 ECD, 0.11 thick) | 478.8 |
| AgIBr (0.435 ECD, 0.11 thick) | 369.8 |
| Cyan dye-forming coupler C-1 | 602.8 |
| Mask CM-1 | 25.8 |
| DIR-1 | 45.2 |
| Bleach accelerator coupler B-1 | 120.6 |
| Gelatin | 1,937.5 |
| Layer 3 | |
| (MC layer) This layer was comprised of a sensitized tabular silver iodobromide emulsion containing 4.5% iodide | |
| AgIBr (1.51 ECD, 0.13 thick) (XFC2140) | 785.8 |
| Cyan dye-forming coupler C-1 | 269.1 |
| Mask CM-1 | 32.3 |
| DIR-1 | 53.8 |
| Yellow dye-forming coupler Y-1 | 59.4 |
| Gelatin | 1087.2 |
| Layer 4 | |
| (FC layer) This layer was comprised of a sensitized a tabular silver iodobromide emulsion 3.7% iodide | |
| AgIBr (2.28 ECD, 0.12 thick) | 1001 |
| Cyan dye-forming coupler C-1 | 139.9 |
| Mask CM-1 | 26.9 |
| DIR-2 | 43.1 |
| DIR-3 | 48.4 |
| Bleach accelerator coupler B-1 | 10.8 |
| Gelatin | 1237.8 |
| Layer 5 (Interlayer) | |
| Oxidized developer scavenger S-1 | 75.3 |
| Advanced development accelerator ADA-1 | 29.1 |
| Gelatin | 1237.8 |

-continued

| | mg/m$^2$ |
|---|---|
| Layer 6 | |
| (SM layer) This layer was comprised of a blend of a lower and higher sensitivity sensitized tabular silver iodobromide emulsions respectively containing 3 and 1.5% iod | |
| AgIBr (0.47 ECD, 0.12 thick) | 430.6 |
| AgIBr (0.55 FCD, 0.08 thick) | 258.3 |
| Magenta dye-forming coupler M-1 | 387.5 |
| Mask MM-1 | 96.9 |
| DIR-4 | 11.3 |
| DIR-5 | 14.1 |
| Gelatin | 1506.9 |
| Layer 7 | |
| (MM layer) This layer was comprised of a blend of a lower and higher sensitivity sensitized tabular silver iodobromide emulsions respectively containing 4.5% iodide | |
| AgIBr (1.28 ECD, 0.13 thick) | 796.5 |
| AgIBr (0.79 ECD, 0.11 thick) | 107.6 |
| Magenta dye-forming coupler M-1 | 258.3 |
| Mask MM-1 | 113.0 |
| DIR-4 | 26.9 |
| DIR-5 | 16.1 |
| Gelatin | 1387.5 |
| Layer 8 | |
| (FM layer) This layer was comprised of a sensitized tabular silver iodobromide emulsion containing 4.5% iodide | |
| AgIBr (1.82 ECD, 0.13 thick) | 828.8 |
| Magenta dye-forming coupler M-1 | 77.5 |
| Mask MM-1 | 32.3 |
| DIR-6 | 2.2 |
| DIR-5 | 23.7 |
| Gelatin | 1023.5 |
| Layer 9 (Interlayer) | |
| Oxidized developer scavenger S-1 | 129.2 |
| Advanced development accelerator ADA-1 | 32.3 |
| Gelatin | 968.8 |
| Layer 10 | |
| (SY layer) This layer was comprised of a blend of lower and higher sensitivity sensitized tablular silver iodobromide emulsions respectively containing 4.1, 1.4 and 1.5% iodide | |
| AgIBr (1.8 ECD, 0.13 thick) | 301.39 |
| AgIBr (0.775 ECD, 0. 14 thick) | 344.449 |
| AgIBr (0.55 ECD, 0.08 thick) | 258.339 |
| Yellow dye-forming coupler Y-1 | 688.89 |
| Yellow dye-forming coupler Y-2 | 344.44 |
| Cyan dye-forming coupler C-1 | 43.06 |
| DIR-7 | 215.28 |
| DIR-8 | 16.15 |
| Bleach accelerator coupler B-1 | 10.76 |
| Gelatin | 1829.86 |
| Layer 11 | |
| (FY layer) This layer was comprised of a sensitized tabular silver iodobromide emulsion containing 4.1% iodide | |
| AgIBr (2.67 ECD, 0.13 thick) | 710.42 |
| Yellow dye-forming coupler Y-1 | 258.33 |
| DIR-7 | 86.11 |
| Bleach accelerator coupler B-1 | 6.46 |
| Oxidized developer scavenger S-1 | 5.38 |
| Gelatin | 861.11 |
| Layer 12 (Ultraviolet Filter Layer) | |
| Dye UV-1 | 108 |

-continued

| | mg/m$^2$ |
|---|---|
| Dye UV-2 | 108 |
| Unsensitized silver bromide Lippmann emulsion | 215 |
| HBS-1 | 168 |
| Gelatin | 699 |
| Layer 13 (Protective Overcoat Layer) | |
| Polymethylmethacrylate matte beads | 54 |
| Soluble polymethylmethacrylate matte beads | 108 |
| Silicone lubricant | 39 |
| Gelatin | 888 |

This film was hardened at the time of coating with 1.6% by weight of total gelatin of hardener H-1. Surfactants, coating aids, soluble absorber dyes, antifoggants, stabilizers, antistatic agents, biostats, biocides, and other addenda chemicals were added to the various layers of this sample, as is commonly practiced in the art.

Sample 002: Invention (Triple Coat Invention)

Layers 1–9 were prepared as in Comparison 1 (above). Thereafter, the FY and SY layers were replaced with the following layers.

| | mg/m$^2$ |
|---|---|
| Layer 10 (SY layer) This layer was comprised of a sensitized tabular silver iodobromide emulsion containing 1.5% iodide | |
| AgIBr (0.55 ECD, 0.08 thick) | 406.9 |
| Yellow dye-forming coupler Y-1 | 189.4 |
| Yellow dye-forming coupler Y-2 | 96.9 |
| Cyan dye-forming coupler C-1 | 42.8 |
| DIR-2 | 42.8 |
| Bleach accelerator coupler B-1 | 10.8 |
| Gelatin | 1,076.4 |
| Layer 11 (MY layer) This layer was comprised of a blend of lower and higher sensitivity sensitized tabular silver iodobromide emulsions respectively containing 4.1 and 1.4% iodide | |
| AgIBr (1.8 ECD, 0.13 thick) | 228.7 |
| AgIBr (0.775 ECD, 0.14 thick) | 262.2 |
| Yellow dye-forming coupler Y-1 | 839.6 |
| DIR-7 | 80.7 |
| Gelatin | 1453.2 |
| Layer 11 (FY layer) This layer was comprised of a sensitized tabular silver iodobromide emulsion containing 4.1% iodide | |
| AgIBr (2.67 ECD, 0.13 thick) | 710.4 |
| Yellow dye-forming coupler Y-1 | 366.0 |
| DIR-7 | 86.1 |
| Bleach accelerator coupler B-1 | 6.5 |
| Oxidized developer scavenger S-1 | 5.4 |
| Gelatin | 861.1 |

These layers were overcoated as in Sample 1.

The chemical interactions among the individual color specific recording layers were determined as detailed below. Sequential, individual gradient exposures of blue, green and red enriched light (obtained by filtration of a white light source with appropriate filters as disclosed in 'Handbook of Kodak Photographic Filters, ISBN 0-87985-658-0) were applied to both samples 001 and 002. These additive exposures were balanced by appropriate neutral density filters so that the sum of the B, G, and R additive exposures, when processed in a traditional chromogenic developer, provided the same sensitometric response (viz. speed balance) as obtained from a single, white light (5500K) exposure. This is shown graphically in FIG. 1 where, for each color record (red=R, green=G and blue=B) the result of the added exposures are denoted by the dashed lines and the result of the white light exposure is denoted by the solid lines. These are slightly offset for the purposes of illustration, but in the real application the lines for the summed individual and white light exposures would be the same.

From the sensitometric response curve, various exposure domains can be defined as follows: A normal (N) exposure is defined as 0.7 log E more exposure than the exposure at which density is 0.15 more than the density at which there is no exposure, also called Dmin. Further, an N−2 or 2 under exposure is defined as the exposure which is 0.6 log E less than the normal exposure. Similarly, an N+4 or four over exposure is 1.2 log E more than the normal exposure. On any color curve, the densities at N, N−2 and N+4 are indicated with subscripts n, n−2 and n+4.

Figure 2:
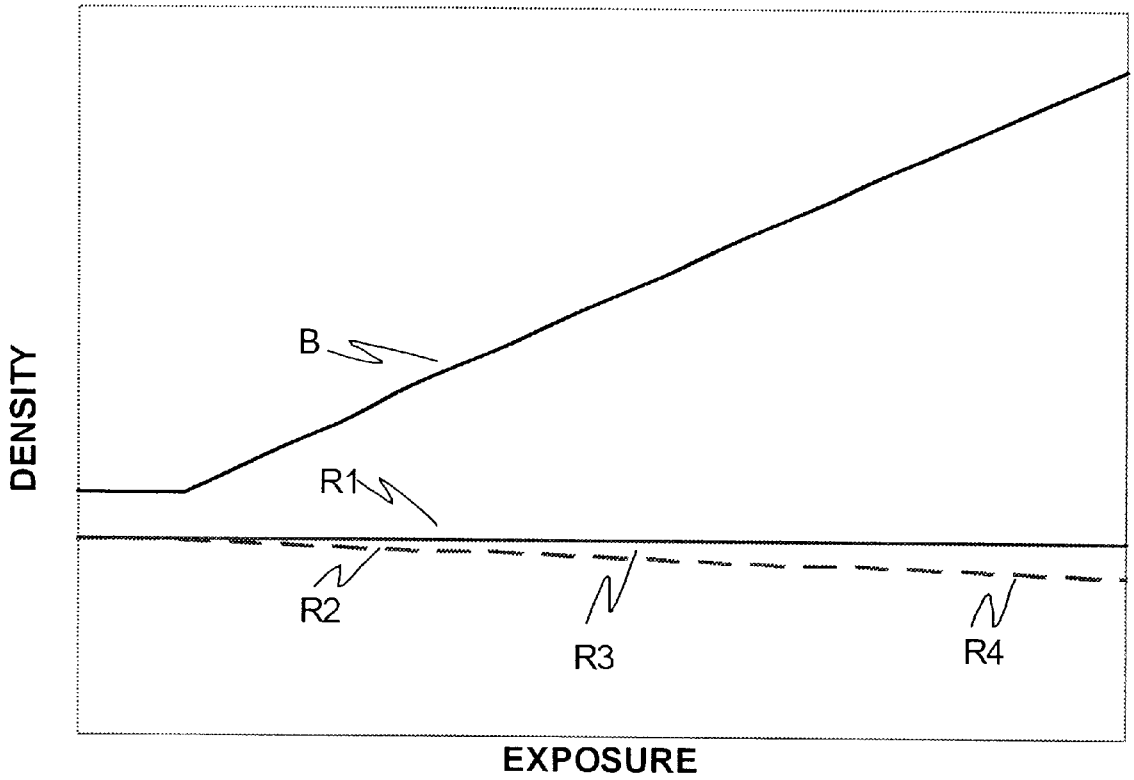
FIG. 2 is a graph showing the density effect of a stepped variation in the blue exposure on a constant red exposure.

By using the exposure necessary to provide the additive neutral exposure, the effect of blue layer on the red layer was determined as follows. This is shown graphically in FIG. 2. The Blue Step exposure (B) was applied in combination with red exposure which was not stepped but was a uniform flash (R). The level of red flash was chosen so that the density was equal to Rn of the uniform exposure (red density at N of the stepped exposure). Without the Blue Step exposure, the red flash (denoted with the symbol R1 in FIG. 2) is uniform. With the Blue Step exposure, the red flash (denoted with the symbols R2, R3, and R4 in FIG. 2) changes as a function of exposure and blue density formation. The effect of the blue record on the red non-stepped exposure is the difference (Eq. 1) of red density at D-min (where there is no blue development) and red density at under (symbol R2 in FIG. 2), normal (symbol R3 in FIG. 2) and over exposures (symbol R4 in FIG. 2) in the blue stepped exposure (where there are increasing amounts of blue development). The effect of the blue record on the green record was determined similarly.

$$B \rightarrow R_n = \text{R (no blue exposure)} - R_n\text{(plus blue exposure)} \quad \text{Equation 1a:}$$

$$B \rightarrow R_{n-2} = \text{R (no blue exposure)} - R_{n-2}\text{(plus blue exposure at } N-2) \quad \text{Equation 1b:}$$

$$B \rightarrow R_{n+4} = R\text{(no blue exposure)} - R_{n+4}\text{(plus blue exposure at } N+4) \quad \text{Equation 1c:}$$

For Sample 001 and Sample 002, the effect of the blue record on the red is shown in Table 1a. In the comparison having only two blue sensitive layers, the effect of the blue record on the red increases at the highest exposure. For the invention, the effect of the blue record on the red is desirably consistent over all exposures. The effect of the blue record on the green (Table 1b) is maintained in the invention.

TABLE 1a

Effect of Blue Layer on Red

| | Change in red flash density @ | | |
|---|---|---|---|
| | N − 2 | N | N + 4 |
| Sample 001 Comparison | −0.02 | −0.04 | −0.12 |
| Sample 002 Invention | −0.02 | −0.04 | −0.04 |

TABLE 1b

| Effect of blue layer on green | | | |
|---|---|---|---|
| | Change in green flash density @ | | |
| | N − 2 | N | N + 4 |
| Sample 001 Comparison | −0.09 | −0.13 | −0.12 |
| Sample 002 Invention | −0.08 | −0.12 | −0.10 |

Figure 3:
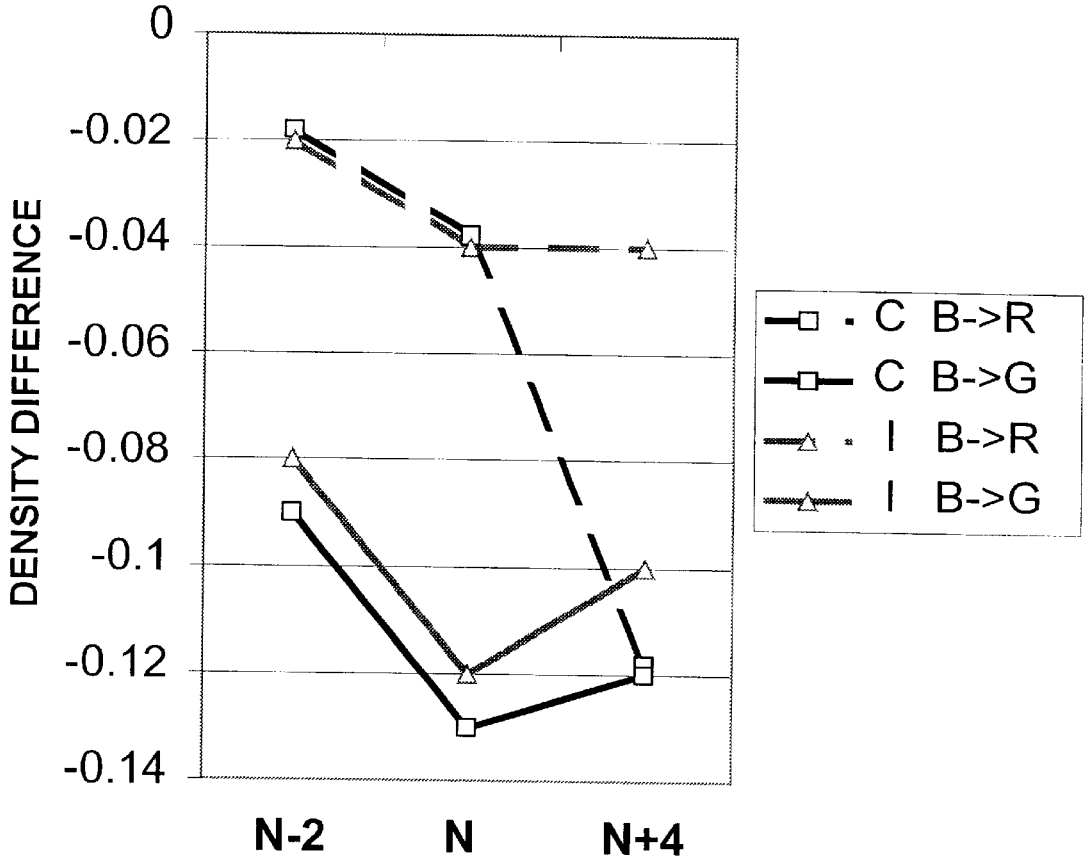
FIG. 3 is a graph showing the consistency of the blue onto red effect using the invention vs. a comparison.

These data are plotted in FIG. 3 where the effect of the blue on the green (B→G) is noted by solid lines and the effect of the blue on the red (B→R) is noted by dashed lines, and the comparison C is noted by squares and the invention I is noted by triangles. FIG. 3 shows that the effect of the blue layers on the green is similar at all exposures, but the effect of the blue layer on the red is much more constant for the invention than it is for the comparison.

Example 2

Effect of Time in $DIR_1$

Sample 003: Comparison (Triple Coat With DIR-9, Strong Inhibitor, No Timing Group)

| | mg/m$^2$ |
|---|---|
| Layer 1 (Antihalation layer) | |
| Black colloidal silver sol | 172 |
| Oxidized developer scavenger S-1 | 135 |
| Colored coupler CD-2 | 25 |
| Colored coupler YD-1 | 10 |
| Advanced development accelerator ADA-1 | 22 |
| gelatin | 1614.6 |
| Layer 2 | |
| (SC layer) This layer was comprised of a blend of a lower and higher sensitivity sensitized tabular silver iodobromide emulsions respectively containing 4.1, 4.1 and 1.5% iodide | |
| AgIBr (1.07 ECD, 0.11 thick) | 203 |
| AgIBr (0.66 ECD, 0.12 thick) | 203 |
| AgIBr (0.55 ECD, 0.08 thick) | 441 |
| Cyan dye-forming coupler C-1 | 602.8 |
| Mask CM-1 | 25.8 |
| DIR-1 | 45.2 |
| Bleach accelerator coupler B-1 | 120.6 |
| Gelatin | 1,937.5 |
| Layer 3 | |
| (MC layer) This layer was comprised of a sensitized tabular silver iodobromide emulsion containing 4.1% iodide | |
| AgIBr (1.3 ECD, 0.12 thick) | 785.8 |
| Cyan dye-forming coupler C-1 | 269.1 |
| Mask CM-1 | 32.3 |
| DIR-1 | 53.8 |
| Yellow dye-forming coupler Y-1 | 107.6 |
| Gelatin | 1076 |
| Layer 4 | |
| (FC layer) This layer was comprised of a sensitized a tabular silver iodobromide emulsion 3.7% iodide | |
| AgIBr (2.28 ECD, 0.12 thick) | 1001 |
| Cyan dye-forming coupler C-1 | 129 |
| Mask CM-1 | 26.9 |
| DIR-2 | 43.1 |
| DIR-3 | 48.4 |
| Bleach accelerator counter B-1 | 10.8 |
| Gelatin | 1237.8 |
| Layer 5 (Interlayer) | |
| Oxidized developer scavenger S-1 | 75.3 |
| Advanced development accelerator ADA-1 | 29.1 |
| Gelatin | 538 |

-continued

| | mg/m$^2$ |
|---|---|
| Layer 6 | |
| (SM layer) This layer was comprised of a blend of a lower and higher sensitivity sensitized tabular silver iodobromide emulsions respectively containing 4.1 and 1.5% iodide and a 3.5% iodide cubic emulsion | |
| AgIBr (0.87 ECD, 0.11 thick) | 417.6 |
| AgIBr (0.28 cube) | 151.8 |
| AgIBr (0.55 ECD, 0.08 thick) | 76.4 |
| Magenta dye-forming coupler M-1 | 387.5 |
| Mask MM-1 | 96.9 |
| DIR-4 | 21.5 |
| Gelatin | 1506.9 |
| Layer 7 | |
| (MM layer) This layer was comprised of a blend of a lower and higher sensitivity sensitized tabular silver iodobromide emulsions respectively containrng 4.5% iodide | |
| AgIBr (1.28 ECD, 0.13 thick) | 753.5 |
| AgIBr (0.79 ECD, 0.11 thick) | 150.7 |
| Magenta dye-forming coupler M-1 | 258.3 |
| Mask MM-I | 113.0 |
| DIR-4 | 26.9 |
| DIR-5 | 16.1 |
| Gelatin | 1372.4 |
| Layer 8 | |
| (FM layer) This layer was comprised of a sensitized tabular silver iodobromide emulsion containing 4.5% iodide | |
| AgIBr (1.82 ECD, 0.13 thick) | 828.8 |
| Magenta dye-forming coupler M-1 | 86 |
| Mask MM-1 | 32.3 |
| DIR-6 | 2.2 |
| DIR-5 | 8.6 |
| DIR-4 | 17.2 |
| Gelatin | 1119 |
| Layer 9 (Interlayer) | |
| Oxidized developer scavenger S-1 | 129.2 |
| Advanced development accelerator ADA-1 | 32.3 |
| Gelatin | 968.8 |
| Layer 10 | |
| (SY layer) This layer was comprised of a sensitized tabular silver iodobromide emulsion containing 1.5% iodide | |
| AgIBr (0.55 ECD, 0.08 thick) | 406.9 |
| Yellow dye-forming coupler Y-1 | 189.4 |
| Yellow dye-forming coupler Y-2 | 96.9 |
| Cyan dye-forming coupler C-1 | 42.8 |
| DIR-9 | 32.9 |
| Bleach accelerator coupler B-1 | 10.8 |
| Gelatin | 1184 |
| Layer 11 | |
| (MY layer) This layer was comprised of a blend of lower and higher sensitivity sensitized tabular silver iodobromide emulsions respectively containing 4.1 and 1.4% iodide | |
| AgIBr (1.8 ECD, 0.13 thick) | 228.7 |
| AgIBr (0.775 ECD, 0.14 thick) | 262.2 |
| Yellow dye-forming coupler Y-1 | 839.6 |
| DIR-7 | 80.7 |
| Gelatin | 1291.7 |
| Layer 12 | |
| (FY layer) This layer was comprised of a sensitized tabular silver iodobromide emulsion containing 9.7% iodide | |
| AgIBr (1.22 ECD, 0.12 thick) | 710.42 |
| Yellow dye-forming coupler Y-1 | 258.33 |
| DIR-7 | 86.11 |
| Bleach accelerator coupler B-1 | 6.46 |
| Gelatin | 861.11 |
| Layer 13 (Ultraviolet Filter Layer) | |
| Dye UV-1 | 96.9 |
| Dye UV-2 | 96.9 |
| Unsensitized silver bromide Lippmann emulsion | 215 |
| HBS-1 | 168 |

-continued

| | mg/m$^2$ |
|---|---|
| Gelatin | 1238 |
| Layer 14 (Protective Overcoat Layer) | |
| Polymethylmethacrylate matte beads | 54 |
| Soluble polymethylmethacrylate matte beads | 108 |
| Silicone lubricant | 39 |
| Gelatin | 888 |

| | mg/m$^2$ |
|---|---|
| Layer 10 (SY layer) This layer was comprised of a sensitized tabular silver iodobromide emulsion containing 1.5% iodide | |
| AgIBr (0.55 ECD, 0.08 thick) | 406.9 |
| Yellow dye-forming coupler Y-1 | 189.4 |
| Yellow dye-forming coupler Y-2 | 96.9 |
| Cyan dye-forming coupler C-1 | 42.8 |
| DIR-9 | 32.9 |
| Bleach accelerator coupler B-1 | 10.8 |
| Gelatin | 1184 |
| Layer 11 (MY layer) This layer was comprised of a blend of lower and higher sensitivity sensitized tabular silver iodobromide emulsions respectively containing 4.1 and 1.4% iodide | |
| AgIBr (1.8 ECD, 0.13 thick) | 228.7 |
| AgIBr (0.775 ECD, 0.14 thick) | 262.2 |
| Yellow dye-forming coupler Y-1 | 839.6 |
| DIR-7 | 80.7 |
| Gelatin | 1291.7 |
| Layer 12 (FY layer) This layer was comprised of a sensitized tabular silver iodobromide emulsion containing 9.7% iodide | |
| AgIBr (1.22 ECD, 0.12 thick) | 710.42 |
| Yellow dye-forming coupler Y-1 | 258.33 |
| DIR-7 | 86.11 |
| Bleach accelerator coupler B-1 | 6.46 |
| Gelatin | 861.11 |
| Layer 13 (Ultraviolet Filter Layer) | |
| Dye UV-1 | 96.9 |
| Dye UV-2 | 96.9 |
| Unsensitized silver bromide Lippmann emulsion | 215 |
| HBS-1 | 168 |
| Gelatin | 1238 |
| Layer 14 (Protective Overcoat Layer) | |
| Polymethylmethacrylate matte beads | 54 |
| Soluble polymethylmethacrylate matte beads | 108 |
| Silicone lubricant | 39 |
| Gelatin | 888 |

This film was hardened at the time of coating with 1.6% by weight of total gelatin of hardener H-1. Surfactants, coating aids, soluble absorber dyes, antifoggants, stabilizers, antistatic agents, biostats, biocides, and other addenda chemicals were added to the various layers of this sample, as is commonly practiced in the art.

Sample 004: Invention (Invention Triple Coat)

Layers 1–9 and 11–13 were prepared as in Comparison 1 (above). Layer 10 was substituted with the following layer.

| Layer 10 (SY layer) This layer was comprised of a sensitized tabular silver iodobromide emulsion containing 1.5% iodide | mg/m$^2$ |
|---|---|
| AgIBr (0.55 ECD, 0.08 thick) | 406.9 |
| Yellow dye-forming coupler Y-1 | 189.4 |
| Yeflow dye-forming coupler Y-2 | 96.9 |
| Cyan dye-forming coupler C-1 | 42.8 |
| DIR-2 | 42.8 |
| Bleach accelerator coupler B-1 | 10.8 |
| Gelatin | 1,076.4 |

TABLE 2a

Effect of Blue layer on red

| | Change in red flash density @ | | |
|---|---|---|---|
| | N − 2 | N | N + 4 |
| Sample 003 Comparison | 0 | −0.04 | −0.04 |
| Sample 004 Invention | 0 | −0.03 | −0.04 |

TABLE 2b

Effect of Blue layer on green

| | Change in green flash density @ | | |
|---|---|---|---|
| | N − 2 | N | N + 4 |
| Sample 003 Comparison | −0.09 | −0.13 | −0.14 |
| Sample 004 Invention | −0.09 | −0.14 | −0.12 |

TABLE 2c

Density formation in blue layer

| | Blue density formed at D-max |
|---|---|
| Sample 003 comparison | 2.975 |
| Sample 004 Invention | 3.176 |

Tables 2a and 2b show the inhibiting effect of the blue record on the red and green records. Table 3a shows the amount of density formed in the blue record. The blue records of Samples 003 (comparison) and 004 (Invention) have the same effect on the red record (Table 2a) and the green record (Table 2b). Sample 003 (comparison), however, forms less blue density at D-max (Table 2c). This is not desirable because the color rendition would not be equivalent at the various exposure levels.

Example 3

Effect of High Strength Inhibitor as $Inh_1$

Sample 005: Comparison 4a (DIR With Low Strength Inhibitor)

Layers 1–9 and 11–14 were prepared as in Sample 003 (above). Layer 10 was substituted with the following layer.

| Layer 10 (SY layer) This layer was comprised of a sensitized tabular silver iodobromide emulsion containing 1.5% iodide | mg/m$^2$ |
|---|---|
| AgIBr (0.55 ECD, 0.08 thick) | 406.9 |
| Yellow dye-forming coupler Y-1 | 189.4 |
| Yellow dye-forming coupler Y-2 | 96.9 |
| DIR-3 | 30.6 |
| Bleach accelerator coupler B-1 (114EMZ) | 10.8 |
| Gelatin | 1,076.4 |

| Layer 10 (SY layer) This layer was comprised of a sensitized tabular silver iodobromide emulsion containing 1.5% iodide | mg/m$^2$ |
|---|---|
| AgIBr (0.55 ECD, 0.08 thick) | 406.9 |
| Yellow dye-forming coupler Y-1 | 189.4 |
| Yellow dye-forming coupler Y-2 | 96.9 |
| Cyan dye-forming coupler C-1 | 85.7 |
| Bleach accelerator coupler B-1 | 10.8 |
| Gelatin | 1,076.4 |

The preferred formulation described in Sample 004 (Invention) will be compared with Samples 005 and 006. In the case of the Sample 005(DIR-3), there is more B→R and less B→G, which is not desirable for color rendition. Sample 6 (no DIR, add cyan coupler) provides adequate b→R but the amount of B→G is reduced, especially in the over exposures.

TABLE 3a

Effect of Blue layer on red

| | Change in red flash density @ | | |
|---|---|---|---|
| | N − 2 | N | N + 4 |
| Sample 005 Comparison | 0 | −0.07 | −0.08 |
| Sample 006 Comparison | 0 | −0.05 | −0.05 |
| Sample 004 Invention | 0 | −0.03 | −0.04 |

Effect of blue layer on green

| | Change in green flash density @ | | |
|---|---|---|---|
| | N − 2 | N | N + 4 |
| Sample 005 Comparison | −0.09 | −0.10 | −0.08 |
| Sample 006 Comparison | −0.09 | −0.12 | −0.04 |
| Sample 004 Invention | −0.09 | −0.14 | −0.12 |

Example 4

Effect of Double vs. Triple Coat With Yellow Dye-forming DIR Coupler in Slowest Blue Layer Sample 007: Comparison (a Double Coat With DIR-7 in Slowest Blue Layer)

| | mg/m$^2$ |
|---|---|
| Layer 1 (Antihalation layer) | |
| Black colloidal silver sol | 172 |
| Oxidized developer scavenger S-1 | 135 |
| Colored coupler CD-2 | 25 |
| Colored coupler YD-1 | 10 |
| gelatin | 1614.6 |
| Layer 2 (Interlayer) | |
| Oxidized developer scavenger S-1 | 75 |
| Advanced development accelerator ADA-1 | 43 |
| gelatin | 538 |
| Layer 3 (SC layer) This layer was comprised of a blend of a lower and higher sensitivity sensitized tabular silver iodobromide emulsions respectively containing 4.1, 4.1 and 1.5% iodide | |
| AgIBr (1.07 ECD, 0.11 thick) | 258 |
| AgIBr (0.66 ECD, 0.12 thick) | 258 |
| AgIBr (0.55 ECD, 0.08 thick) | 560 |
| Cyan dye-forming coupler C-1 | 538 |
| Mask CM-1 | 11 |
| DIR-10 | 86 |
| Bleach accelerator coupler B-1 | 108 |
| Gelatin | 2368 |
| Layer 4 (MC layer) This layer was comprised of a sensitized tabular silver iodobromide emulsion containing 4.1% iodide | |
| AgIBr (1.3 ECD, 0.12 thick) | 1012 |
| Cyan dye-forming coupler C-1 | 323 |
| Mask CM-1 | 32.3 |
| DIR-8 | 54 |
| Yellow dye-forming coupler Y-1 | 107.6 |
| Gelatin | 1292 |
| Layer 5 (FC layer) This layer was comprised of a sensitized a tabular silver iodobromide emulsion 3.7% iodide | |
| AgIBr (2.61 ECD, 0.12 thick) | 1119 |
| Cyan dye-forming coupler C-1 | 129 |
| Mask CM-1 | 26.9 |
| DIR-2 | 43.1 |
| DIR-3 | 48.4 |
| Bleach accelerator coupler B-1 | 10.8 |
| Gelatin | 1237.8 |
| Layer 6 (Interlayer) | |
| Oxidized developer scavenger S-1 | 75.3 |
| Advanced development accelerator ADA-1 | 39 |
| Yellow dye YD-3 | 97 |
| Gelatin | 538 |
| Layer 7 (SM layer) This layer was comprised of a blend of a lower and higher sensitivity sensitized tabular silver iodobromide emulsions respectively containing 4.1 and 1.5% iodide and a 3.5% iodide cubic emulsion | |
| AgIBr (0.87 ECD, 0.11 thick) | 474 |
| AgIBr (0.28 cube) | 172 |
| AgIBr (0.55 ECD, 0.08 thick) | 86 |
| Magenta dye-forming coupler M-1 | 387.5 |
| Mask MM-1 | 96.9 |
| DIR-5 | 16 |
| Gelatin | 1729 |
| Layer 8 (MM layer) This layer was comprised of a blend of a lower and higher sensitivity sensitized tabular silver iodobromide emulsions respectively containing 4.5% iodide | |
| AgIBr (1.28 ECD, 0.13 thick) | 581 |
| AgIBr (0.79 ECD, 0.11 thick) | 452 |
| Magenta dye-forming coupler M-1 | 258.3 |
| Mask MM-1 | 113.0 |

-continued

| | mg/m$^2$ |
|---|---|
| DIR-4 | 26.9 |
| DIR-5 | 16.1 |
| Gelatin | 1292 |
| Layer 9 | |
| (FM layer) This layer was comprised of a sensitized tabular silver iodobromide emulsion containing 4.5% iodide | |
| AgIBr (1.82 ECD, 0.13 thick) | 947 |
| Magenta dye-forming coupler M-1 | 97 |
| Mask MM-1 | 32.3 |
| DIR-6 | 2.2 |
| DIR-5 | 32 |
| Gelatin | 1119 |
| Layer 10 (Interlayer) | |
| Oxidized developer scavenger S-1 | 75 |
| Advanced development accelerator ADA-1 | 43 |
| Gelatin | 646 |
| Layer 11 | |
| (SY layer) This layer was comprised of a blend of lower and higher sensitivity sensitized tabular silver iodobromide emulsions respectively containing 4.1, 1.4 and 1.5% iodide | |
| AgIBr (1.8 ECD, 0.13 thick) | 301.39 |
| AgIBr (0.775 ECD, 0.14 thick) | 344.449 |
| AgIBr (0.55 ECD, 0.08 thick) | 258.339 |
| Yellow dye-forming coupler Y-1 | 688.89 |
| Yellow dye-forming coupler Y-2 | 344.44 |
| Cyan dye-fonning coupler C-1 | 43.06 |
| DIR-7 | 215.28 |
| DIR-8 | 16.15 |
| Bleach accelerator coupler B-1 | 10.76 |
| Gelatin | 1829.86 |
| Layer 12 | |
| (FY layer) This layer was comprised of a sensitized tabular silver iodobromide emulsion containing 9.7% iodide | |
| AgIBr (1.22 ECD, 0.12 thick) | 818 |
| Yellow dye-forming coupler Y-1 | 323 |
| DIR-7 | 86.11 |
| Bleach accelerator coupler B-1 | 6.46 |
| Oxidized developer scavenger S-1 | 5.38 |
| Gelatin | 1184 |
| Layer 13 (Ultraviolet Filter Layer) | |
| Dye UV-1 | 96.9 |
| Dye UV-2 | 96.9 |
| Unsensitized silver bromide Lippmann emulsion | 215 |
| HBS-1 | 168 |
| Gelatin | 1238 |
| Layer 13 (Protective Overcoat Layer) | |
| Polymethylmethacrylate matte beads | 54 |
| Soluble polymethylmethacrylate matte beads | 108 |
| Silicone lubricant | 39 |
| Gelatin | 888 |

This film was hardened at the time of coating with 1.6% by weight of total gelatin of hardener H-1. Surfactants, coating aids, soluble absorber dyes, antifoggants, stabilizers, antistatic agents, biostats, biocides, and other addenda chemicals were added to the various layers of this sample, as is commonly practiced in the art.

Sample 008: Invention (a Triple Coat With DIR-7 in Slowest Blue Layer)

Layers 1–10 were prepared as in Comparison 1 (above). Thereafter, the SY layer was replaced with the following layers.

| | mg/m$^2$ |
|---|---|
| Layer 10 | |
| (SY layer) This layer was comprised of a sensitized tabular silver iodobromide emulsion containing 1.5% iodide | |
| AgIBr (0.55 ECD, 0.08 thick) | 258 |
| Yellow dye-forming coupler Y-1 | 194 |
| Yellow dye-forming coupler Y-2 | 99 |
| Cyan dye-forming coupler C-1 | 8 |
| DIR-7 | 31 |
| DIR-2 | 35 |
| Bleach accelerator coupler B-1 | 10.8 |
| Gelatin | 1184 |
| Layer 11 | |
| (MY layer) This layer was comprised of a blend of lower and higher sensitivity sensitized tabular silver iodobromide emulsions respectively containing 4.1 and 1.4% iodide | |
| AgIBr (1.8 ECD, 0.13 thick) | 301 |
| AgIBr (0.775 ECD, 0.14 thick) | 344 |
| Yellow dye-forming coupler Y-1 | 495 |
| Yellow dye-forming coupler Y-2 | 245 |
| DIR-7 | 77 |
| Gelatin | 1076 |

TABLE 4a

Effect of Blue layer on Red

| | Change in red flash density @ | | |
|---|---|---|---|
| | N − 2 | N | N + 4 |
| Sample 007 Comparison | 0 | −0.05 | −0.13 |
| Sample 008 Invention | 0 | −0.05 | −0.08 |

TABLE 4b

Effect of Blue layer on green

| | Change in green flash density @ | | |
|---|---|---|---|
| | N − 2 | N | N + 4 |
| Sample 007 Comparison | −0.09 | −0.13 | −0.20 |
| Sample 008 Invention | −0.09 | −0.14 | −0.19 |

Tables 4a and 4b show the effect of the blue record on the red and green records. The consistency of blue onto green is maintained while improving the consistency of blue onto red when using 3 vs. two blue layers in the presence of a yellow DIR coupler in the slow blue layer.

Example 5

Sample 009: Comparison (Triple Coat With DIR-2 in MY)

| | mg/m$^2$ |
|---|---|
| Layer 1 (Antihalation layer) | |
| Black colloidal silver sol | 172 |
| Oxidized developer scavenger S-1 | 135 |
| Colored coupler CD-2 | 25 |
| Colored coupler YD-1 | 10 |
| gelatin | 1614.6 |
| Layer 2 (Interlayer) | |
| ADA-1 | 43 |

-continued

| | mg/m$^2$ |
|---|---|
| Oxidized developer scavenger S-1 | 75 |
| gelatin | 538 |
| Layer 3 | |
| (SC layer) This layer was comprised of a blend of a lower and higher sensitivity sensitized tabular silver iodobromide emulsions respectively containing 4.1, 4.1 and 1.5% iodide | |
| AgIBr (1.07 ECD, 0.11 thick) | 258 |
| AgIBr (0.66 ECD, 0.12 thick) | 258 |
| AgIBr (0.55 ECD, 0.08 thick) | 560 |
| Cyan dye-forming coupler C-1 | 538 |
| Mask CM-1 | 11 |
| DIR-10 | 86 |
| Bleach accelerator coupler B-1 | 108 |
| Gelatin | 2368 |
| Layer 4 | |
| (MC layer) This layer was comprised of a sensitized tabular silver iodobromide emulsion containing 4.1% iodide | |
| AgIBr (1.3 ECD, 0.12 thick) | 1011 |
| Cyan dye-forming coupler C-1 | 323 |
| Mask CM-1 | 32.3 |
| DIR-8 | 53.8 |
| Yellow dye-forming coupler Y-1 | 107.6 |
| Gelatin | 1292 |
| Layer 5 | |
| (FC layer) This layer was comprised of a sensitized a tabular silver iodobromide emulsion 3.7% iodide | |
| AgIBr (2.61 ECD, 0.12 thick) | 1119 |
| Cyan dye-forming coupler C-1 | 129 |
| Mask CM-1 | 26.9 |
| DIR-2 | 43.1 |
| DIR-3 | 48.4 |
| Bleach accelerator coupler B-1 | 10.8 |
| Gelatin | 1237.8 |
| Layer 6 (Interlayer) | |
| Oxidized developer scavenger S-1 | 75.3 |
| Advanced development accelerator ADA-1 | 39 |
| Gelatin | 538 |
| Layer 7 | |
| (SM layer) This layer was comprised of a blend of a lower and higher sensitivity sensitized tabular silver iodobromide emulsions respectively containing 4.1 and 1.5% iodide and a 3.5% iodide cubic emulsion | |
| AgIBr (0.87 ECD, 0.11 thick) | 474 |
| AgIBr (0.28 cube) | 172 |
| AgIBr (0.55 ECD, 0.08 thick) | 86 |
| Magenta dye-forming coupler M-1 | 387.5 |
| Mask MM-1 | 96.9 |
| DIR-5 | 16 |
| DIR-4 | 12.9 |
| Gelatin | 1729 |
| Layer 8 | |
| (MM layer) This layer was comprised of a blend of a lower and higher sensitivity sensitized tabular silver iodobromide emulsions respectively containing 4.5% iodide | |
| AgIBr (1.28 ECD, 0.13 thick) | 581 |
| AgIBr (0.79 ECD, 0.11 thick) | 452 |
| Magenta dye-forming coupler M-1 | 258.3 |
| Mask MM-1 | 113.0 |
| DIR-4 | 26.9 |
| DIR-5 | 16.1 |
| Gelatin | 1292 |
| Layer 9 | |
| (FM layer) This layer was comprised of a sensitized tabular silver iodobromide emulsion containing 4.5% iodide | |
| AgIBr (1.82 ECD, 0.13 thick) | 947 |
| Magenta dye-forming coupler M-1 | 97 |
| Mask MM-1 | 32.3 |
| DIR-6 | 2.2 |
| DIR-5 | 32 |
| Gelatin | 1119 |

-continued

| | mg/m$^2$ |
|---|---|
| Layer 10 | |
| (Interlayer) | |
| Oxidized developer scavenger S-1 | 75.3 |
| Advanced development accelerator ADA-1 | 43 |
| Gelatin | 646 |
| Layer 11 | |
| (SY layer) This layer was comprised of a sensitized tabular silver iodobromide emulsion containing 1.5% iodide | |
| AgIBr (0.55 ECD, 0.08 thick) | 258 |
| Yellow dye-forming coupler Y-1 | 194 |
| Yellow dye-forming coupler Y-2 | 99 |
| Cyan dye-forming coupler C-1 | 42.8 |
| Bleach accelerator coupler B-1 | 10.8 |
| Gelatin | 753 |
| Layer 12 | |
| (MY layer) This layer was comprised of a blend of lower and higher sensitivity sensitized tabular silver iodobromide emulsions respectively containing 4.1 and 1.4% iodide | |
| AgIBr (1.8 ECD, 0.13 thick) | 302 |
| AgIBr (0.775 ECD, 0.14 thick) | 344 |
| Yellow dye-forming coupler Y-1 | 491 |
| DIR-8 | 26 |
| DIR-7 | 77 |
| Gelatin | 1076 |
| Layer 13 | |
| (FY layer) This layer was comprised of a sensitized tabular silver iodobromide emulsion containing 9.7% iodide | |
| AgIBr (1.22 ECD, 0.12 thick) | 818 |
| Yellow dye-forming coupler Y-1 | 323 |
| DIR-7 | 86.11 |
| Bleach accelerator coupler B-1 | 6.46 |
| Gelatin | 1184 |

This film was hardened at the time of coating with 1.6% by weight of total gelatin of hardener H-1. Surfactants, coating aids, soluble absorber dyes, antifoggants, stabilizers, antistatic agents, biostats, biocides, and other addenda chemicals were added to the various layers of this sample, as is commonly practiced in the art.

Sample 010: Invention (Triple Coat)

Layers 1–10 and 13–15 were prepared as in Comparison 1 (above). Layer 11 was substituted with the following layer.

| Layer 11 | |
|---|---|
| (SY layer) This layer was comprised of a sensitized tabular silver iodobromide emulsion containing 1.5% iodide | mg/m$^2$ |
| AgIBr (0.55 ECD, 0.08 thick) | 258 |
| Yellow dye-forming coupler Y-1 | 194 |
| Yellow dye-forming coupler Y-2 | 99 |
| Cyan dye-forming coupler C-1 | 42.8 |
| DIR-8 | 26 |
| Bleach accelerator coupler B-1 | 10.8 |
| Gelatin | 753 |

Layer 12 was substituted with the following layer.

| Layer 12 | |
|---|---|
| (MY layer) This layer was comprised of a blend of lower and higher sensitivity sensitized tabular silver iodobromide emulsions respectively containing 4.1 and 1.4% iodide | |
| AgIBr (1.8 ECD, 0.13 thick) | 302 |
| AgIBr (0.775 ECD, 0.14 thick) | 344 |

-continued

| Layer 12 | |
|---|---|
| (MY layer) This layer was comprised of a blend of lower and higher sensitivity sensitized tabular silver iodobromide emulsions respectively containing 4.1 and 1.4% iodide | |
| Yellow dye-forming coupler Y-1 | 491 |
| DIR-7 | 77 |
| Gelatin | 1076 |

TABLE 5a

Effect of Blue layer on red

| | Change in red flash density @ | | |
|---|---|---|---|
| | N − 2 | N | N + 4 |
| Sample 009 Comparison | −0.01 | −0.05 | −0.04 |
| Sample 010 Invention | 0 | −0.03 | −0.04 |

TABLE 5b

Effect of Blue layer on green

| | Change in green flash density @ | | |
|---|---|---|---|
| | N − 2 | N | N + 4 |
| Sample 009 Comparison | −0.09 | −0.13 | −0.14 |
| Sample 010 Invention | −0.10 | −0.13 | −0.12 |

TABLE 5c

Density formation in blue layer

| | Blue density formed at D-max |
|---|---|
| Sample 009 comparison | 3.2 |
| Sample 010 Invention | 3.4 |

Tables 5a and 5b show the effect of the blue record on the red and green records. Table 5c shows the amount of density formed in the blue record. The blue records of Samples 009 (comparison) and 010 (Invention) have the same effect on the red record (Table 5a) and the green record (Table 5b). Sample 009 (comparison), however, forms less blue density at D-max (Table 5c). This is less desirable, since this density would have to be recovered by adding more yellow dye-forming coupler and/or more silver in order to maintain a neutral tone scale.

The entire contents of the patents and other publications referred to in this specification are incorporated herein by reference.

What is claimed is:

1. A photographic element comprising a support bearing a blue light sensitive record containing at least three yellow dye-forming layers having different levels of light sensitivity arranged in the order slowest to fastest with the slowest layer closest to the support and the fastest layer closest to the light exposure source, wherein:

a) all of the blue-sensitive layers are closer to the light exposure source than the layers sensitive to any other color;

b) the slowest blue light sensitive layer is at least 1.0 log E slower than the next fastest blue light sensitive layer when measured at a density of 0.15 above Dmin, and contains a cyan dye-forming development inhibitor releasing (DIR) coupler represented by $DIR_1$;

$$DIR_1=Coup_1\text{-Time-}Inh_1$$

wherein $Coup_1$ is a coupler nucleus that releases -Time-$Inh_1$ and forms a cyan dye upon reaction with oxidized developer, Time is a group that permits -Time-$Inh_1$ to be cleaved from $Coup_1$ and to diffuse within the photographic element during development processing and is thereafter cleaved from $Inh_1$, and $Inh_1$ is an inhibitor group of high strength capable of inhibiting the development of a silver halide emulsion upon release from Time;

c) all of the blue light sensitive layers other than the slowest blue light sensitive layer independently contain a yellow dye-forming DIR coupler represented by $DIR_2$:

$$DIR_2=Coup_2\text{-}Inh_2$$

wherein $Coup_2$ is a coupler nucleus that releases -$Inh_2$ and forms a yellow dye upon reaction with oxidized developer during development processing, and $Inh_2$ is an inhibitor group capable of inhibiting the development of a silver halide emulsion other than one qualifying as a high strength inhibitor.

2. The element of claim 1 wherein $Inh_2$ is an inhibitor of moderate strength.

3. The element of claim 1 wherein the element contains four blue light sensitive layers.

4. The element of claim 1 wherein the element contains three blue light sensitive layers.

5. The element of claim 1 wherein at least one of $Inh_1$ or $Inh_2$ contains a group that is deactivated during development processing.

6. The element of claim 1 wherein of the timing group contained by $DIR_1$ releases the inhibitor group by an intramolecular nucleophilic substitution reaction, by an electron transfer reaction along a conjugated system, or by functioning as a coupler or reducing agent after the coupler reaction.

7. The element of claim 6 wherein the TIME group contained by $DIR_1$ includes a quinone methide, cabamate or aminoacid group.

8. The element of claim 7 wherein the TIME group contained by $DIR_1$ is a quinone methide group.

9. The element of claim 1 wherein $DIR_1$ is a naphthol or phenol based coupler.

10. The element of claim 1 wherein $Inh_1$ is a mercaptotetrazole group.

11. The element of claim 10 wherein the mercaptotetrazole group is a phenyl-mercaptotetrazole group or a p-methoxybenzyl-mercaptotetrazole group.

12. The element of claim 1 wherein $Coup_2$ is an acylacetanilide nucleus.

13. The element of claim 12 wherein $Inh_2$ is deactivated during development processing.

14. The element of claim 2 wherein the moderate strength inhibitor $Inh_2$ is a benzotriazole group.

15. The element of claim 1 wherein the slowest blue light sensitive layer contains a second DIR coupler.

16. The element of claim 15 wherein the second DIR coupler is present in a minor proportion, on a weight basis, of the total DIR couplers in the layer.

17. The element of claim 1 additionally containing at least three layers sensitive to green light and at least three layers sensitive to red light.

18. The element of claim 1 wherein at lest one of the blue light sensitive layers comprises tabular, flat crystals with an aspect ratio (diameter/thickness) of at least 4.0.

19. A process for forming an image in an imagewise exposed element as described in claim 1 comprising contacting the element with a color developing agent.

20. The process of claim 19 wherein the color developing agent is a para-phenylenediamine.

* * * * *